US008127958B2

(12) United States Patent
Furuichi et al.

(10) Patent No.: US 8,127,958 B2
(45) Date of Patent: Mar. 6, 2012

(54) FITTING FOR BEVERAGE CONTAINER

(75) Inventors: Kazuo Furuichi, Tokyo (JP); Hiroshi Furuichi, Tokyo (JP); Motohiro Inagaki, Tokyo (JP)

(73) Assignee: Fuji Techno Co., Ltd., Tokyo (JP)

( * ) Notice: Subject to any disclaimer, the term of this patent is extended or adjusted under 35 U.S.C. 154(b) by 431 days.

(21) Appl. No.: 11/990,852

(22) PCT Filed: Aug. 18, 2006

(86) PCT No.: PCT/JP2006/316265

§ 371 (c)(1),
(2), (4) Date: Feb. 22, 2008

(87) PCT Pub. No.: WO2007/023748

PCT Pub. Date: Mar. 1, 2007

(65) Prior Publication Data

US 2009/0134177 A1 May 28, 2009

(30) Foreign Application Priority Data

Aug. 22, 2005 (JP) ..... 2005-239334
Feb. 20, 2006 (JP) ..... 2006-041987
Mar. 20, 2006 (JP) ..... 2006-077632

(51) Int. Cl.
*B65D 51/16* (2006.01)

(52) U.S. Cl. ..... 220/203.13; 220/694; 215/355; 215/315; 222/400.7

(58) Field of Classification Search ..... 215/355, 215/230, 307, 309, 311, 315; 222/146.6, 222/399, 400.7, 466, 325; 137/330, 283, 137/247.17, 315.19, 315.31, 515.5, 515.7, 137/15.17, 15.18, 15.21, 15.24; 220/203.13, 220/694

See application file for complete search history.

(56) References Cited

U.S. PATENT DOCUMENTS 4,583,654 A * 4/1986 Pufpaff et al. ..... 220/789
(Continued)

FOREIGN PATENT DOCUMENTS

EP 1 477 456 A2 11/2004
(Continued)

OTHER PUBLICATIONS

Internatonal Search Report mailed on Nov. 14, 2006.

*Primary Examiner* — Jacob K Ackun
*Assistant Examiner* — Kareen Rush
(74) *Attorney, Agent, or Firm* — Rader, Fishman & Grauer PLLC

(57) ABSTRACT

The present invention provides a fitting for a beverage container capable of completely preventing foreign matter, dirty water and so on from entering by eliminating a gap between a ferrule and an attachment member, and enabling a reduction in maintenance operations. The fitting for a beverage container comprises a ferrule of a beverage container in which a valve seat portion and an attachment portion are provided integrally, a down tube supported by the attachment portion, a gas valve fitted onto an upper end portion of the down tube, and a beverage valve provided in the interior of the upper end portion of the down tube. The gas valve is constituted by a metallic core metal 31*a* and a valve member having increased flexibility, and a plan outer peripheral shape of the core metal comprises a constant diameter portion 311 having a constant diameter and a small diameter portion 312*a* having a smaller diameter than the constant diameter portion. The plan outer peripheral shape forms a graphic that is symmetrical to both a first straight line A passing through the center of the core metal and the constant diameter portion, and a second straight line B that intersects the first straight line in the center. The gas valve is capable of passing through a central hole in the valve seat portion when tilted but incapable of passing through the central hole in the valve seat portion when horizontal, and can be replaced through the central hole in the valve seat portion.

7 Claims, 17 Drawing Sheets

U.S. PATENT DOCUMENTS

| | | | | |
|---|---|---|---|---|
| 5,579,912 | A * | 12/1996 | Yamamoto | 206/509 |
| 6,105,825 | A * | 8/2000 | Gomi et al. | 222/146.6 |
| 6,230,892 | B1 * | 5/2001 | Przytulla et al. | 206/509 |
| 6,308,869 | B1 | 10/2001 | Simpson | |
| 6,619,560 | B1 * | 9/2003 | Chun | 239/44 |
| 6,957,745 | B2 * | 10/2005 | Thibault et al. | 215/249 |
| 2003/0209512 | A1 * | 11/2003 | Guyot | 215/355 |

FOREIGN PATENT DOCUMENTS

| | | | |
|---|---|---|---|
| JP | 01-099993 | A | 4/1989 |
| JP | 07-232799 | A | 9/1995 |
| JP | 2000-079991 | A | 3/2000 |
| JP | 2002-274598 | A | 9/2002 |

* cited by examiner

FITTING FOR BEVERAGE CONTAINER

TECHNICAL FIELD

The present invention relates to a fitting for a beverage container that is fixed to a beverage container such as a beer barrel as a ferrule and connected to a dispensing head, and more particularly to a fitting for a beverage container capable of completely preventing foreign matter, rainwater and so on from entering by eliminating a gap between the ferrule and an attachment member, and enabling a reduction in maintenance operations.

BACKGROUND ART

In a conventional beverage container such as a beer barrel, a ferrule is fixed to the beverage container by welding or the like, and a fitting is attached to the ferrule by screwing. A dispensing head is then connected to the fitting. Pressurized gas such as carbon dioxide is supplied to the beverage container through the dispensing head, and thus the beverage in the beverage container is dispensed to the exterior of the container. The manner in which a conventional fitting is attached to a ferrule will now be described with reference to FIGS. 25 and 26.

FIG. 25 is a sectional view showing the manner in which a conventional fitting is attached to a beverage container from the front. FIG. 26 is an enlarged sectional view showing a part of the fitting and the ferrule. FIG. 25 shows a case in which the beverage is draft beer and the beverage container is a beer barrel. An attachment member 2 of the fitting is screwed fixedly to the inside of a ferrule 91 provided on an upper portion of a beer barrel 9. Further, a down tube 5 biased upward by a spring is attached to the attachment member 2.

A gas valve 3 is fixed to an upper end portion of the down tube 5, and a beer valve 4 is provided in the interior of the upper end of the down tube 5 so as to be biased upward. The gas valve 3 and beer valve 4 are set in a closed state by the biasing force of a coil spring. A dispensing head may be attached to the ferrule 91 and the attachment member 2. The attachment member 2 and dispensing head can be joined easily by a connecting mechanism constituted by an engaging protrusion 22 and an engaging recess portion.

The dispensing head is a device for manipulating the gas valve 3 and beer valve 4 such that a pressurized gas such as carbon dioxide gas is supplied to the interior of the beer barrel 9, thereby raising the internal pressure of the beer barrel 9 such that the draft beer is dispensed to the exterior of the container. The draft beer is dispensed to the exterior of the container through the down tube 5 and the beer valve 4. To prevent gas leakage between the ferrule 91 and the attachment member 2, packing 92 is provided between a lower portion inner surface of the ferrule 91 and the attachment member 2.

A shooting prevention member 8 prevents the attachment member 2 from being shot upward by the internal gas pressure of the beer barrel 9 when the attachment member 2 is detached from the ferrule 91. A stopper 81 contacts the lower surface of the ferrule 91, thereby preventing the ferrule 91 from shooting upward. When the gas valve 3 is pushed down by a detachment tool, pressurized gas escapes from the interior of the beer barrel 9 and the stopper 81 is pulled inward, and thus the attachment member 2 can be detached from the ferrule 91.

Although the attachment member 2 is screwed fixedly to the ferrule 91 in the fitting constituted in this manner, a minute gap exists between the ferrule 91 and the attachment member 2. Rainwater and draft beer enter through this gap. This dirty water that enters through the gap is prevented from infiltrating the interior of the beer barrel 9 by the packing 92 but in terms of hygiene, it is not desirable for the dirty water to remain between the ferrule 91 and attachment member 2 for a long time. When the beer barrel is washed and sterilized at a high temperature, the dirty water in the gap is ejected through ebullition, and therefore it is possible to check whether or not any dirty water remains in the gap. The dirty water in the gap may seep out through the gap due to thermal expansion when the beer barrel is placed under hot sunlight or the like, and may also infiltrate the interior of the ferrule, thereby contaminating the draft beer.

Hence, the inventor of the present application has proposed the fitting described in Patent Document 1. In the fitting of Patent Document 1, a second sealing member is provided on an uppermost portion of the fitting in addition to a first sealing member for sealing the gap between the lower portion inner surface of the ferrule and the attachment member, thereby making it difficult for foreign matter, rainwater and so on to enter through the gap between the ferrule and the attachment member.

Patent Document 1 Japanese Unexamined Patent Application Publication 2000-79991

DISCLOSURE OF THE INVENTION

In a conventional fitting such as that shown in FIGS. 25 and 26, it is undesirable in terms of hygiene for foreign matter, dirty water and so on to infiltrate between the ferrule 91 and the attachment member 2. Moreover, since the packing 92 is formed from a flexible material such as rubber, deterioration thereof due to wear and corrosion is unavoidable, and therefore the packing 92 must be replaced periodically. Hence, in a conventional fitting, maintenance such as a sterilization/washing operation and an operation to replace the packing 92 must be conducted periodically.

Furthermore, even with a fitting such as that described in Patent Document 1, it is difficult to prevent foreign matter, dirty water and so on from entering completely. Moreover, since the first sealing member and second sealing member are also formed from a flexible material such as rubber, deterioration thereof due to wear and corrosion is unavoidable, and therefore these members must be replaced periodically. Hence, although the frequency with which maintenance operations are performed can be reduced with the fitting of Patent Document 1, sterilization/washing operations and operations to replace the first sealing member and second sealing member must be conducted periodically.

It is therefore an object of the present invention to provide a fitting for a beverage container capable of completely preventing foreign matter, dirty water and so on from entering by eliminating a gap between a ferrule and an attachment member, and enabling a reduction in maintenance operations.

To achieve this object, a fitting for a beverage container according to the present invention comprises: an attachment portion provided integrally with a ferrule of a beverage container; a valve seat portion provided on an inner peripheral side of the attachment portion; a tubular down tube, an upper end portion of which is supported by the attachment portion; a gas valve fitted onto the upper end portion of the down tube for supplying a pressurized gas to the interior of the container; and a beverage valve provided in the interior of the upper end portion of the down tube for dispensing a beverage to the exterior of the container. The gas valve can be replaced through a central hole in the valve seat portion.

Further, in the fitting for a beverage container described above, the gas valve is preferably constituted by a metallic core metal formed such that a part of the diameter thereof is smaller than the diameter of other parts, and a valve member with increased flexibility molded integrally with the core metal, and the gas valve is preferably capable of passing through the central hole in the valve seat portion when tilted, but incapable of passing through the central hole in the valve seat portion when horizontal.

Further, in the fitting for a beverage container described above, a plan outer peripheral shape of the core metal preferably comprises a constant diameter portion having a constant diameter and a small diameter portion having a smaller diameter than the constant diameter portion, and the plan outer peripheral shape constituted by the constant diameter portion and the small diameter portion preferably forms a graphic that is symmetrical to both a first straight line passing through a center of the core metal and the constant diameter portion and a second straight line that intersects the first straight line in the center.

Further, in the fitting for a beverage container described above, the small diameter portion is preferably formed from a line segment which is parallel to the first straight line and positioned at a distance from the center enabling passage through the central hole in the valve seat portion.

Further, in the fitting for a beverage container described above, the small diameter portion preferably forms a curve connected smoothly to the constant diameter portion, and a line segment linking two intersection points between the small diameter portion and the second straight line defines the smallest diameter of the plan outer peripheral shape of the core metal.

Further, in the fitting for a beverage container described above, the curve forming the small diameter portion is preferably positioned on or outside of two straight lines which pass through both ends of the smallest diameter of the plan outer peripheral shape of the core metal and are parallel to the first straight line.

Further, in the fitting for a beverage container described above, the gas valve may be formed by integrally molding a metal fitting, which is formed by integrally connecting the core metal to a reinforcement metal fitting, with the valve member.

Further, in the fitting for a beverage container described above, the gas valve may be formed by molding the core metal integrally with the valve member and then integrally connecting a reinforcement metal fitting thereto.

Further, in the fitting for a beverage container described above, a mark indicating the direction of the first straight line is preferably displayed on the gas valve.

Further, in the fitting for a beverage container described above, the mark on the gas valve is preferably formed when a material of the valve member flows into a recessed groove provided in a metallic part and hardens.

The present invention is constituted as described above, and exhibits the following effects.

The attachment portion and valve seat portion are provided integrally in the ferrule of the beverage container, and since no gaps exist between the ferrule and the upper surface of the attachment member, foreign matter, dirty water and so on do not enter such gaps. As a result, sterilization processing of the ferrule portion, operations to remove foreign matter, and so on can be reduced. Further, operations to replace packing are eliminated and an operation to replace the gas valve can be performed easily, and therefore maintenance operations can be reduced greatly. Furthermore, the number of components of the fitting can be reduced, enabling a reduction in the manufacturing cost of the beverage container. In addition, the outer diameter dimension and weight of the ferrule can be reduced while maintaining compatibility with a conventional fitting, and thus the beverage container can be reduced in size and weight.

When the small diameter portion of the core metal is constituted by a line segment, the core metal can be manufactured easily and at low cost.

When the small diameter portion of the core metal is constituted by a curve that is connected smoothly to the constant diameter portion, the small diameter portion can be caused to jut out without varying the short diameter, enabling an increase in the surface area of the core metal and improvements in the symmetry and durability of the gas valve. Furthermore, when the gas valve is tilted and passed through the central hole in the valve seat portion, the pushing force required to pass the gas valve is substantially constant over the entire small diameter portion, and therefore operations to assemble and detach the gas valve can be performed smoothly.

A metal fitting formed by integrally connecting the core metal and the reinforcement metal fitting is molded integrally with the valve member, and therefore the valve member of the gas valve is adhered to the core metal and reinforcement metal fitting with great strength, enabling an increase in the strength of the gas valve and an improvement in its durability.

The core metal and valve member are molded integrally, and the reinforcement metal fitting is integrally connected thereto, enabling an increase in the strength of the gas valve and an improvement in its durability. Further, the manufacturing process of the gas valve is simple, and hence the gas valve can be manufactured at low cost.

A mark indicating the direction of the first straight line is provided on the gas valve, and therefore the tilting direction of the gas valve can be determined at a glance, enabling a great improvement in the workability of the attachment operation.

EXPLANATION OF REFERENCE NUMERALS

Figure 1:
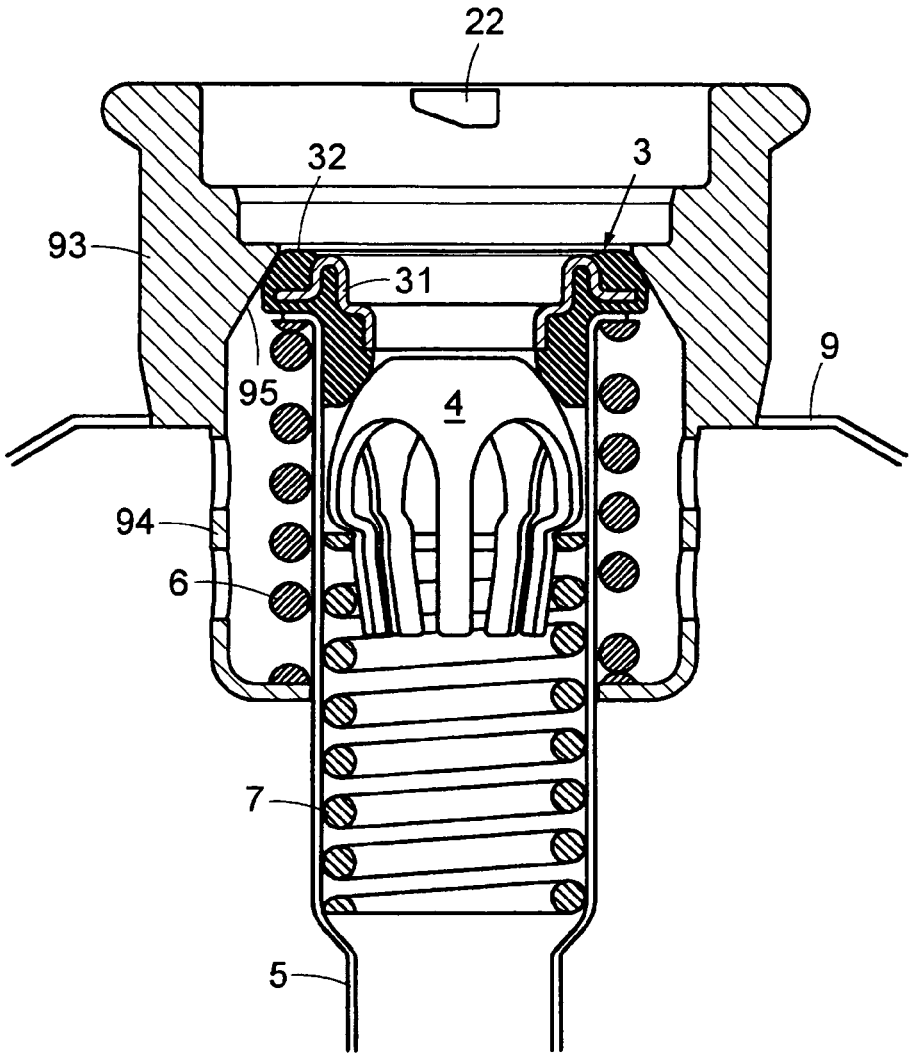
FIG. 1 is a sectional view of a fitting according to a first embodiment of the present invention.

2 attachment member
2*a* joint portion
3, 3*a*, 3*b* gas valve
4 beer valve
5 down tube
6, 7 coil spring
8 shooting prevention member
9 beer barrel
10 operation tool
11 guide portion
12 frame body
13 base
14 moving member
15 handle
16 connecting member
17 attachment tool
18 detachment tool
21 protective ring
21*a* welding portion
22 engaging projection
31, 31*a* core metal
32 valve member
33*a*, 33*b* core metal
34*a*, 34*b* reinforcement metal fitting
81 stopper
91, 93, 96 ferrule
92 packing
93*a* welded portion
94 attachment portion
95 valve seat portion
171, 181 pushing portion
172 support projection
173 support plate
182 pawl portion
311 constant diameter portion
312, 312*a* small diameter portion
313, 341 mark
331 through hole

BEST MODES FOR CARRYING OUT THE INVENTION

Figure 25:
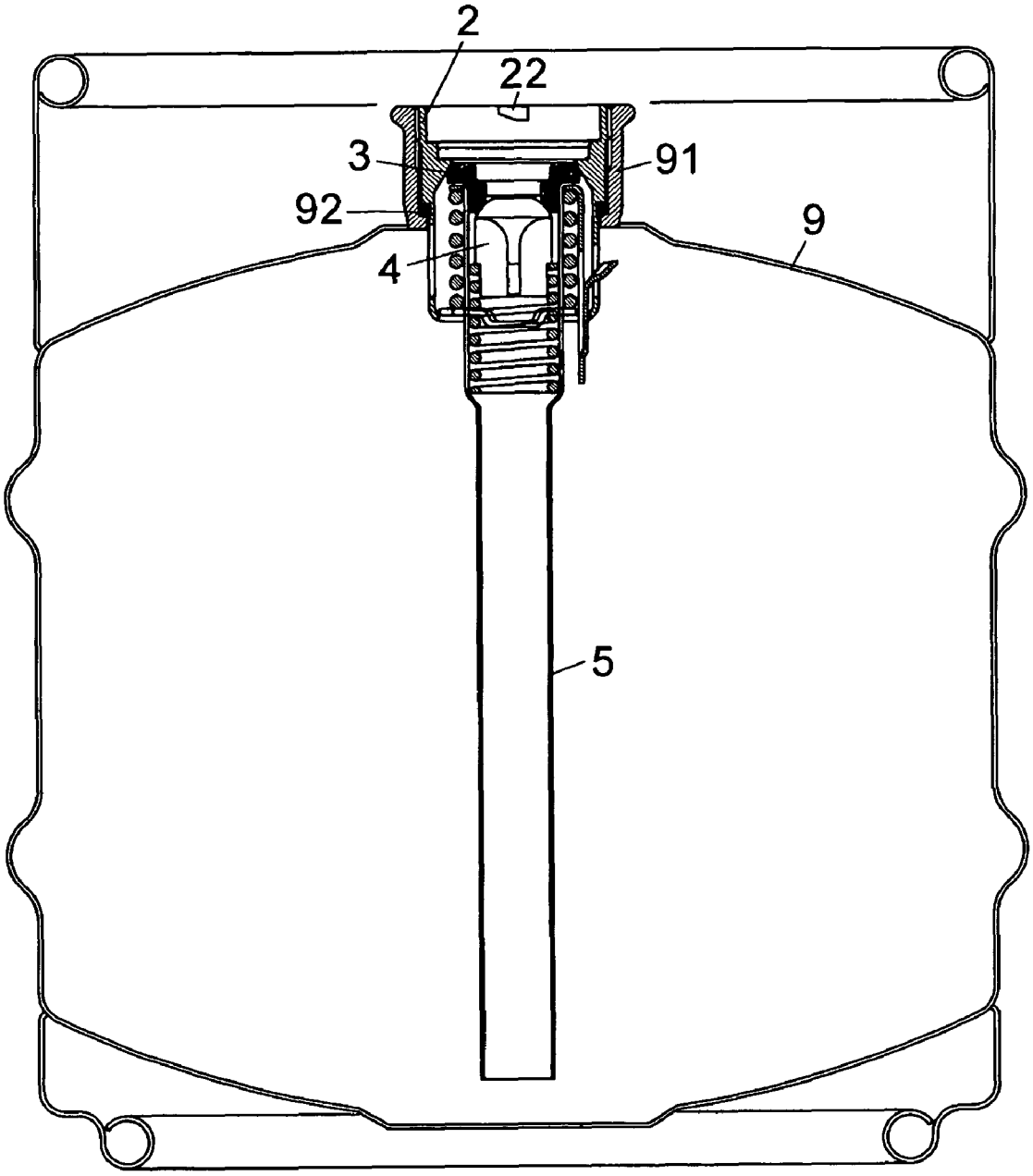
FIG. 25 is a sectional view showing the manner in which a conventional fitting is attached to a beer barrel from the front.
Figure 26:
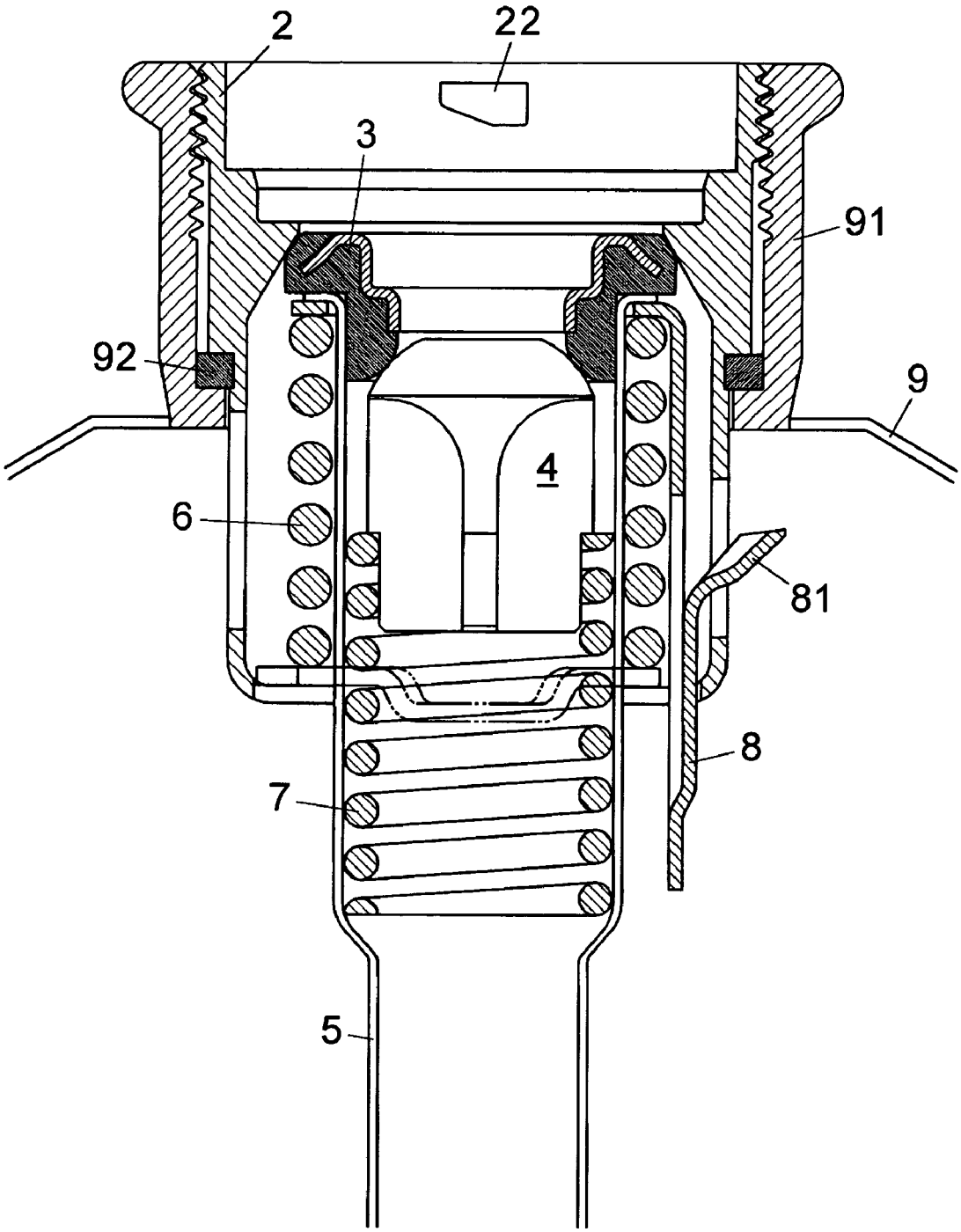
FIG. 26 is an enlarged sectional view showing a conventional fitting.

Embodiments of the present invention will now be described with reference to the drawings. FIG. 1 is a sectional view of a fitting according to a first embodiment of the present invention. The beverage is draft beer, and the beverage container is a beer barrel. As shown in FIGS. 25 and 26, in a conventional fitting, the attachment member 2 of the fitting is screwed fixedly to the inner periphery of the ferrule 91, but in the fitting of the present invention, the ferrule and the attachment member are formed integrally. A ferrule 93 formed integrally with an attachment member is connected fixedly to the beer barrel 9 by welding to form a hermetic container. An attachment portion 94 is formed integrally with the ferrule 93, and a valve seat portion 95 is formed on an inner peripheral side of the ferrule 93.

A down tube 5 biased upward by a spring is supported on the attachment portion 94. A gas valve 3 is fixed to an upper end portion of the down tube 5, and a beer valve 4 is provided in the interior of the upper end of the down tube 5 so as to be biased upward. The gas valve 3 is biased upward together with the down tube 5 by a coil spring 6 and thereby pushed against the valve seat portion 95 on the inner peripheral side of the ferrule 93. The beer valve 4 is pushed against a valve seat part on a lower portion of the gas valve 3 by the biasing force of a coil spring 7. The normal state of the gas valve 3 and beer valve 4 is a closed state.

A dispensing head can be attached to the ferrule 93. An engaging projection 22 projecting inwardly is provided on an upper portion inner peripheral side of the ferrule 93, and the ferrule 93 can be joined to the dispensing head easily by a connecting mechanism constituted by the engaging protrusion 22 and an engaging recess portion. The dispensing head manipulates the gas valve 3 and beer valve 4 such that a pressurized gas such as carbon dioxide gas is supplied to the interior of the beer barrel 9, thereby raising the internal pressure of the beer barrel 9 such that the draft beer can be discharged to the exterior of the container through the down tube 5 and the beer valve 4.

The overall shape of the gas valve 3 is a ring shape, and when in use, the gas valve 3 is disposed such that a central axis thereof is oriented in a vertical direction. The gas valve 3 is formed by molding a valve member 32 made of a flexible material such as rubber integrally with a core metal 31 made of a stainless material or the like. In a conventional gas valve, an outer peripheral edge of the core metal is circular, but in the present invention, the gas valve 3 must be replaced through a central hole in the valve seat portion 95, and therefore the shape of the core metal 31 is different to that of a convention gas valve.

Figure 2:
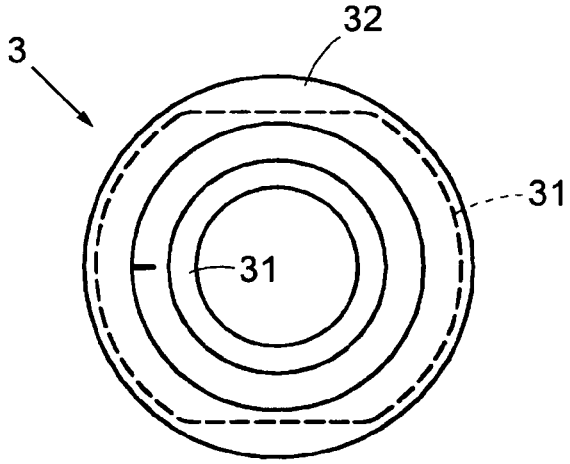
FIG. 2 is a plan view of a gas valve 3 from above.

FIG. 2 is a plan view of the gas valve 3 from above. Parallel flat portions are provided on the outer peripheral edge of the core metal 31 in two symmetrical positions about the center. Accordingly, the diameter (short diameter=distance between flat portions) of the core metal 31 in the positions of the flat portions is smaller than the diameter (long diameter) in an orthogonal direction thereto. The parts in which the flat portions are provided have dimensions that allow passage through the central hole in the valve seat portion 95. In other words, the short diameter dimension of the core metal 31 is smaller than the diameter of the central hole in the valve seat portion 95, and the long diameter dimension of the core metal 31 is larger than the diameter of the central hole in the valve seat portion 95.

Figure 3:
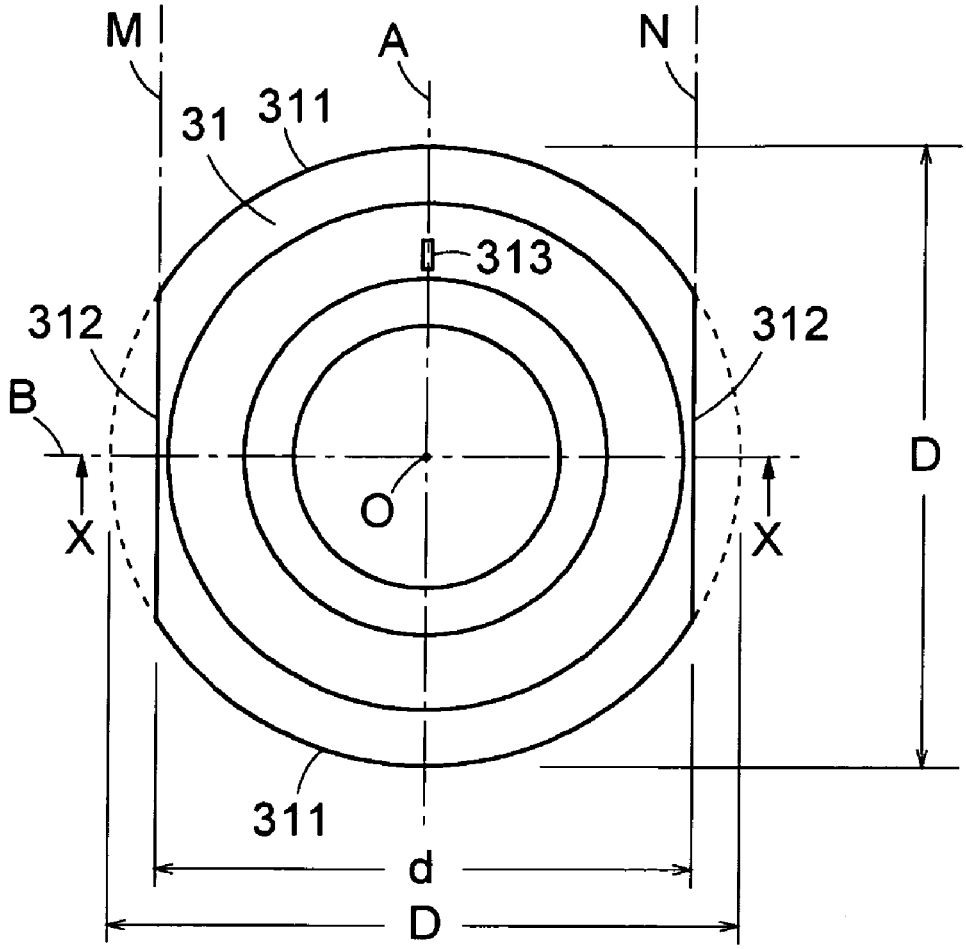
FIG. 3 is a plan view showing the shape of a core metal 31.
Figure 4:
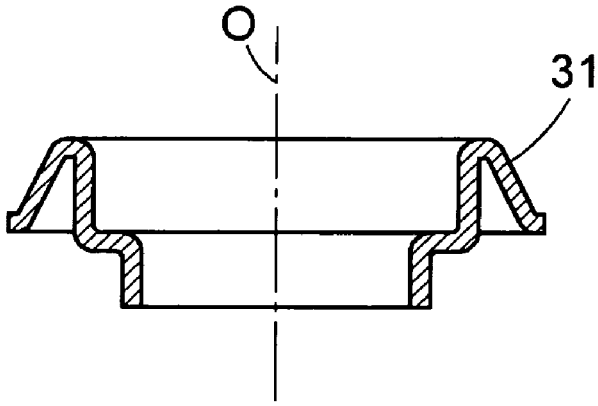
FIG. 4 is a sectional view of the core metal 31.

Referring to FIGS. 3 and 4, the shape of the core metal 31 will be described in further detail. FIG. 3 is a plan view showing the shape of the core metal 31. FIG. 4 is a sectional view of the core metal 31. FIG. 4 shows a cross-section seen along an X-X arrow in FIG. 3. The core metal 31 is formed in a ring shape having a central axis ○ in a vertical direction. In a conventional core metal, the contour of the outer peripheral side seen from above (to be referred to hereafter as the plan outer peripheral shape) is completely circular. In FIG. 3, a conventional circular contour is indicated by dotted lines.

In the core metal 31 of the present invention, a part of the circle is cut away from the plan outer peripheral shape to form a shape having a long axis and a short axis. Here, the long axis direction of the plan outer peripheral shape is set as a straight line A, and the short axis direction is set as a straight line B. The straight line A and the straight line B intersect at a single point on the central axis ○ and are therefore orthogonal to each other. The parts of the circle shown by the dotted lines are cut away from the plan outer peripheral shape of the core metal 31 to form small diameter portions 312. The small diameter portions 312 have a shape that is obtained by cutting away the parts on the outside of two straight lines M, N parallel to the straight line A from the original contour (circle).

The straight lines M, N are parallel to the straight line A, and both are set at a distance of d/2 from the straight line A. Hence, the distance (short diameter) between the opposing small diameter portions 312 is equal to a distance d between the straight lines M, N. The parts of the plan outer peripheral shape of the core metal 31 other than the small diameter portions 312 have a constant diameter and form a constant diameter portion 311. The diameter of the constant diameter portion 311, or in other words the long diameter, has a dimension D shown in the drawing. The constant diameter portion 311 takes an arc shape. As shown in FIG. 3, the plan outer peripheral shape of the core metal 31 is symmetrical about the straight line A and also symmetrical about the straight line B. In a typical example of the dimensions of the core metal 31, the long diameter D is 33 mm and the short diameter d is 28 mm. The diameter of the central hole in the valve seat portion 95 is approximately 31.8 mm, and therefore the long diameter D is larger than the diameter of the central hole, whereas the short diameter d is smaller than the diameter of the central hole.

A mark 313 showing the direction of the straight line A (the long axis direction) is formed on the upper surface of the core metal 31. The mark 313 is formed as a shallow groove in the direction of the straight line A in the apex portion of the core metal 31 upper surface. Even when the core metal 31 and the valve member 32 are molded integrally to complete the gas valve 3, the mark 313 remains exposed from the valve member 32. During integral molding to form the gas valve 3, the rubber material or the like of the valve member 32 flows into the groove of the mark 313, thereby making the mark 313 highly visible.

As will be described in detail below, when the gas valve 3 is attached to the upper end portion of the down tube 5, the gas valve 3 must be tilted in the direction of the straight line A and passed through the central hole in the valve seat portion 95. By providing the mark 313, the straight line A direction of the gas valve 3 (core metal 31) can be recognized at a glance, enabling a dramatic improvement in the workability of the attachment operation. When the mark 313 is not provided, the straight line A direction of the core metal 31 cannot be recognized visually from the outside of the gas valve 3, and therefore the workability deteriorates.

Figure 5:
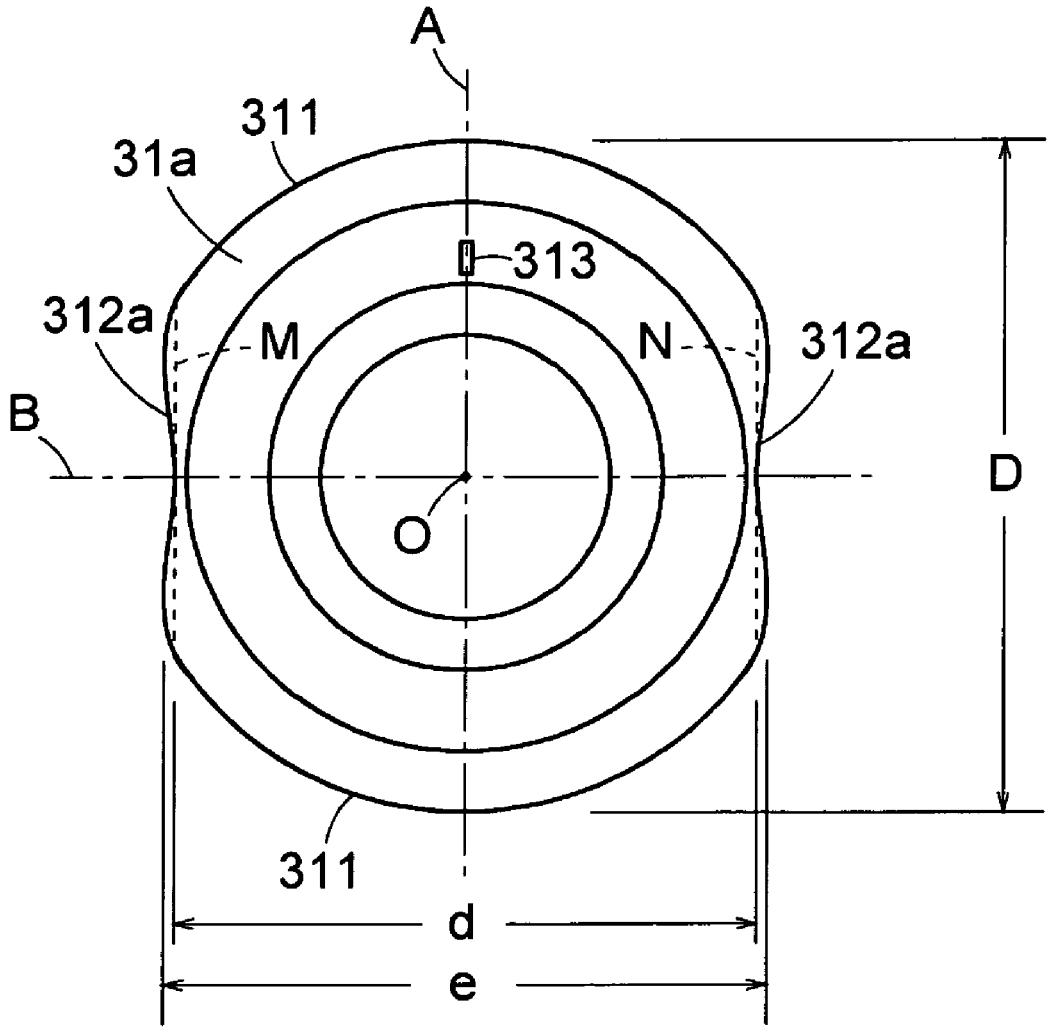
FIG. 5 is a plan view showing the constitution of a core metal 31*a* according to another embodiment.

FIG. 5 is a plan view showing the constitution of a core metal 31*a* according to another embodiment. In the core metal 31*a*, a further improvement is added to the plan outer peripheral shape. The plan outer peripheral shape of the core metal 31*a* also forms a graphic exhibiting line symmetry about both the long axis direction straight line A and the short axis direction straight line B. The lengths of the long diameter and short diameter are also identical to their counterparts in FIG. 3, i.e. long diameter D=33 mm, short diameter d=28 mm. The short diameter d is the shortest diameter of a small diameter portion 312*a*, and serves as the distance between the respective intersection points between the straight line B and the small diameter portions 312*a*, 312*a*.

In the core metal 31 shown in FIG. 3, the small diameter portion 312 is constituted by a line segment, whereas in the core metal 31*a* of FIG. 5, the small diameter portion 312*a* is constituted by a smooth curve. Further, the curve constituting the small diameter portion 312*a* connects smoothly with the arc-shaped constant diameter portion 311. The curve constituting the small diameter portion 312*a* passes through the short diameter position and then juts out beyond the two straight lines M, N parallel to the straight line A. In FIG. 5, the straight lines M, N are indicated by dotted lines. As regards the amount by which the curve juts out, in relation to the short diameter d of 28 mm, a width e of the part that juts out farthest in the straight line B direction is 29 mm. In other words, the curves constituting the small diameter portions 312*a* project to the outside of the straight lines M, N by a maximum of 0.5 mm, respectively.

The mark 313 indicating the straight line A direction (the long axis direction) is also formed on the upper surface of the core metal 31*a*. The mark 313 is formed identically to that shown in FIG. 3, i.e. as a shallow groove in the direction of the straight line A in the apex portion of the core metal 31*a* upper surface. During integral molding to form the gas valve 3, the rubber material or the like of the valve member 32 flows into the groove of the mark 313, thereby making the mark 313 highly visible.

The small diameter portions 312*a* of the core metal 31*a* are constituted by curves for the following reasons. First, it was found as a result of an experiment performed repeatedly to tilt a gas valve employing the core metal 31 shown in FIG. 3 and pass it through the central hole in the valve seat portion 95 that the pushing force generated when passing the central portion of the small diameter portions 312 was maximal, whereas the pushing force before and after was considerably smaller. This indicated the possibility of causing the core metal 31 to jut further outward in locations other than the short diameter portion (the intersection point with the straight line B) of the small diameter portion 312.

Ideally, the plan outer peripheral shape of the core metal is circular, as in a conventional core metal. In the present invention, the core metal is provided with the small diameter portions to allow passage through the central hole in the valve seat portion 95, but in terms of the symmetry and durability of the gas valve, the surface area of the core metal that is cut away from the circle is preferably as small as possible. As shown in FIG. 5, when the small diameter portions 312*a* of the core metal 31*a* are constituted by curves, the plan outer peripheral shape of the core metal 31*a* resembles a circle more closely, leading to improvements in the symmetry and durability of the gas valve. Further, when a gas valve employing the core metal 31*a* is tilted in order to pass through the central hole in the valve seat portion 95, the pushing force required to pass the core metal 31*a* is substantially constant over the entire small diameter portion 312*a*, and therefore operations to incorporate and detach the gas valve can be performed smoothly.

It was confirmed as a result of a durability test performed respectively on gas valves employing the core metals shown in FIGS. 3 and 5 that a conventional durability reference was sufficiently satisfied. More specifically, the following three durability tests were performed on a beer barrel incorporating the gas valve of the present invention.

1. The internal pressure of the beer barrel was increased variably within a range of 0.1 to 3 MPa (1 to 30 atmospheres) 1000 times.
2. The internal pressure of the beer barrel was set at 450 kPa (4.5 atmospheres), whereupon the beer barrel was heated and cooled between 130° C. and 20° C. 1000 times.
3. The internal pressure of the beer barrel was increased variably within a range of 200 to 560 kPa (2 to 5.6 atmospheres)5000 times.

After performing all of the three durability tests described above, no irregularities were observed in the outer form of the gas valve according to the present invention, and no irregularities were observed in the state of adhesion between the core metal and the valve member.

Figure 6:
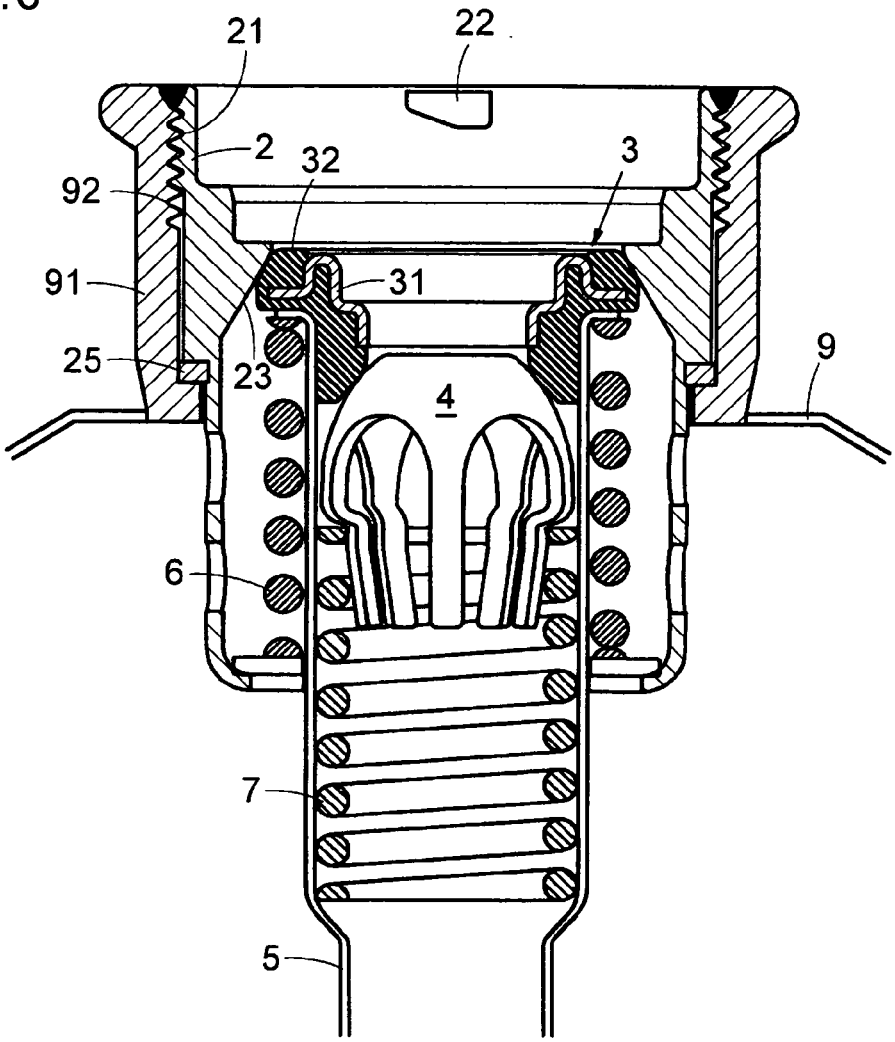
FIG. 6 is a sectional view showing a fitting according to a second embodiment of the present invention.

FIG. 6 is a sectional view showing a fitting according to a second embodiment of the present invention, in which an enlargement of a part near the ferrule 91 of the fitting is seen from the front. In the fitting of FIG. 1, the ferrule 93 differs from a conventional ferrule in that the ferrule 93 and the attachment portion 94 are manufactured integrally from the start. In the fitting shown in FIG. 6, the fitting of the present invention is formed through effective use of the conventionally employed beer barrel 9.

A female screw 92 is formed in the inner periphery of the ferrule 91 provided on the upper portion of the beer barrel 9, and the attachment member 2 of the fitting is screwed fixedly to the female screw 92. In other words, a male screw 21 formed on an outer peripheral upper portion of the attachment member 2 is screwed to the female screw 92. A sealing member 25 is disposed between the lower portion inner surface of the ferrule 91 and the attachment member 2 for preventing gas leakage between the ferrule 91 and attachment member 2. In the present invention, the sealing member 25 is a ring-shaped member constituted by corrosion-resistant flexible stainless steel. By forming the sealing member 25 from stainless steel, the screwing force (screw-tightening torque) of the attachment member 2 relative to the ferrule 91 can be increased in comparison with that of conventional rubber packing.

After screwing the attachment member 2 to the ferrule 91 with sufficient torque, the upper end portion of the ferrule 91 and the upper end portion of the attachment member 2 are fixed to each other and sealed by welding, as shown in FIG. 6. Welding is performed such that any gaps between the two around the entire circumference are completely blocked. In so doing, foreign matter, dirty water and so on from the outside can be completely prevented from entering the gap between the ferrule 91 and the attachment member 2. Furthermore, the pressurized gas in the interior of the beer barrel 9 is also sealed by the sealing member 25 and therefore does not leak to the outside. Moreover, since the sealing member 25 is formed from corrosion-resistant flexible stainless steel, it can be used without replacement until the end of the life of the beer barrel 9. As a result, maintenance operations to replace packing and so on can be reduced.

The valve shown in FIG. 2 may be used as the gas valve 3, while the core metals having the shapes shown in FIGS. 3 through 5 may be used as the core metal. In other words, an identical gas valve to that of the fitting shown in FIG. 1 may be used as the gas valve 3. Similarly to the fitting shown in FIG. 1, in the fitting of FIG. 6 the gas valve 3 is replaced through the central hole in a valve seat portion 23.

The fitting of FIG. 6 may be formed using the conventional beer barrel 9 in the following manner. First, an attachment member 20 of the conventional fitting is detached from the ferrule 91, whereupon the down tube 5 and so on are also detached and packing 24 is replaced with the sealing member 25 made of flexible stainless steel. The conventional gas valve is then replaced with the gas valve 3 or the gas valve 3*a* of the present invention, whereby the attachment member 2 of the present invention is formed. Next, the attachment member 2 is screwed to the ferrule 91 with sufficient torque, whereupon the upper end portion of the ferrule 91 and the upper end portion of the attachment member 2 are fixed to each other and sealed by welding, as shown in FIG. 6.

Thus, the fitting of the present invention can be formed through effective use of a conventional fitting, enabling a large reduction in the costs for introducing the fitting of the present invention and effective use of resources.

Figure 7:
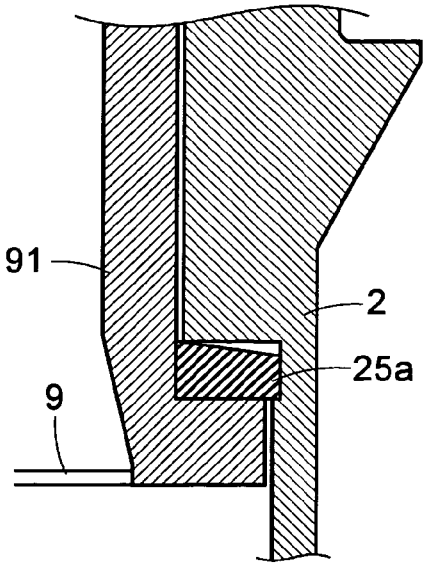
FIG. 7 is a sectional view showing the constitution of a sealing member 25*a* according to another embodiment.

FIG. 7 is a sectional view showing the constitution of a sealing member 25*a* according to another embodiment in the fitting of FIG. 6. The sealing member 25 of FIG. 6 has a rectangular cross-section, as shown in the drawing. In other words, the upper surface and lower surface are formed parallel to each other, and the seal is formed by the planar part. Therefore, when the flatness of a stepped portion on the lower portion inner surface of the ferrule 91 or a stepped portion of the attachment member 2 is poor or the like, the sealing performance may deteriorate. In the sealing member 25*a* of FIG. 7, the upper surface is formed as an inclined surface, and the inclined surface is brought into line contact with the corner portion of the stepped portion on the attachment member 2. As a result, a stable sealing performance is obtained. Due to the line contact, it is easy for the sealing member 25*a* to deform elastically or plastically, and therefore the sealing member 25*a* exhibits a stable sealing performance. Note that here, the upper surface of the sealing member is formed as an inclined surface, but the lower surface may be formed as an inclined surface.

Figure 8:
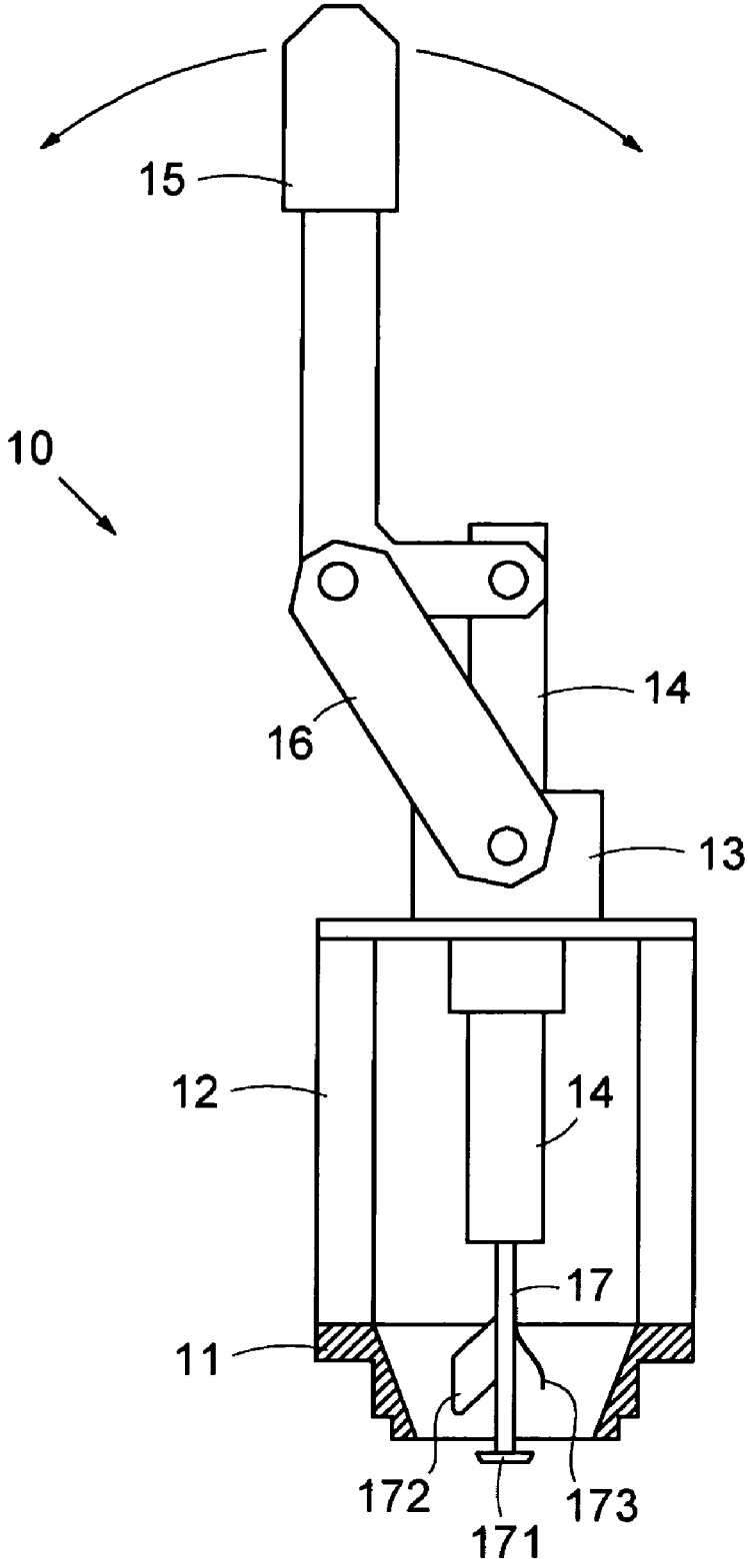
FIG. 8 is a view showing the constitution of an operation tool 10 for incorporating the gas valve 3 into the fitting of the present invention.

FIG. 8 is a view showing the constitution of an operation tool 10 for incorporating the gas valve 3 into the fitting of the present invention. A lower portion of the operation tool 10 is provided with a guide portion 11 that matches the inner surface shape of the ferrule 93 and can be fitted into and fixed to the ferrule 93. The inner surface side of the guide portion 11 forms a substantially conical curved surface having an inner diameter that decreases downward, and by means of this conical inner surface, the gas valve 3 is guided smoothly to a predetermined position on the upper end of the down tube 5.

Although the inner surface shape of the guide portion 11 is a substantially conical rotary surface, the sectional shape thereof is preferably formed with an angle of incline that is closer to a curve (an upwardly projecting curve) than a constant straight line. The upwardly projecting curve is preferably defined such that, although no problem is posed if the angle of incline is substantially constant in its upper portion of the inner surface, the angle of incline is increased (made closer to vertical) on the way down and its lowermost part has a vertical incline. By forming the inner surface shape in this manner, the gas valve 3 can be incorporated smoothly without causing damage or the like to the valve member 32.

Further, although not shown in the drawing, an engaging groove or an engaging hole capable of engaging with the engaging projection 22 on the inner surface of the ferrule 93 is provided in the outer periphery of the guide portion 11. By fitting the guide portion 11 into the ferrule 93 and rotating it by a predetermined angle about a vertical central axis, the guide portion 11 can be fixed to the ferrule 93. A similar mechanism is employed to fix a dispensing head to the ferrule 93.

The guide portion 11 and a base 13 are fixed to each other by a frame body 12. A moving member 14 is provided to be capable of moving up and down relative to the base 13. A handle 15 bent into an L shape is connected rotatably to an upper end portion of the moving member 14. A corner portion of the L shape of the handle 15 and the base 13 are connected by a connecting member 16. The connecting portions are supported so as to be capable of relative rotation. The moving member 14, handle 15, and connecting member 16 constitute a link mechanism allowing the moving member 14 to move in an up-down direction. As shown by the arrow, the moving member 14 can be moved up and down by rotating the handle 15 to the left and right.

An attachment tool 17 for incorporating the gas valve 3 is attached to a lower end of the moving member 14. The attachment tool 17 can be detached from the moving member 14 and replaced with another tool. By detaching the attachment tool 17 and attaching a detachment tool 18 for detaching the gas valve 3 from the fitting, the operation tool 10 can be used as a tool for detaching the gas valve 3.

A pushing portion 171 for pushing the beer valve 4 downward is provided on a lower end side of the attachment tool 17. A support projection 172 and a support plate 173 are provided above the pushing portion 171. The pushing portion 171, support projection 172 and support plate 173 constitute a support portion for supporting the gas valve 3 in a tilted state. The support plate 173 is constituted by a plate-form spring material, and supports the gas valve 3 elastically.

Note that here, a driving mechanism for moving the moving member 14 of the operation tool 10 up and down is described as a link mechanism, but another driving mechanism may be used. A rack/pinion mechanism, a hydraulic cylinder, or another arbitrary driving mechanism may be used.

Figure 9:
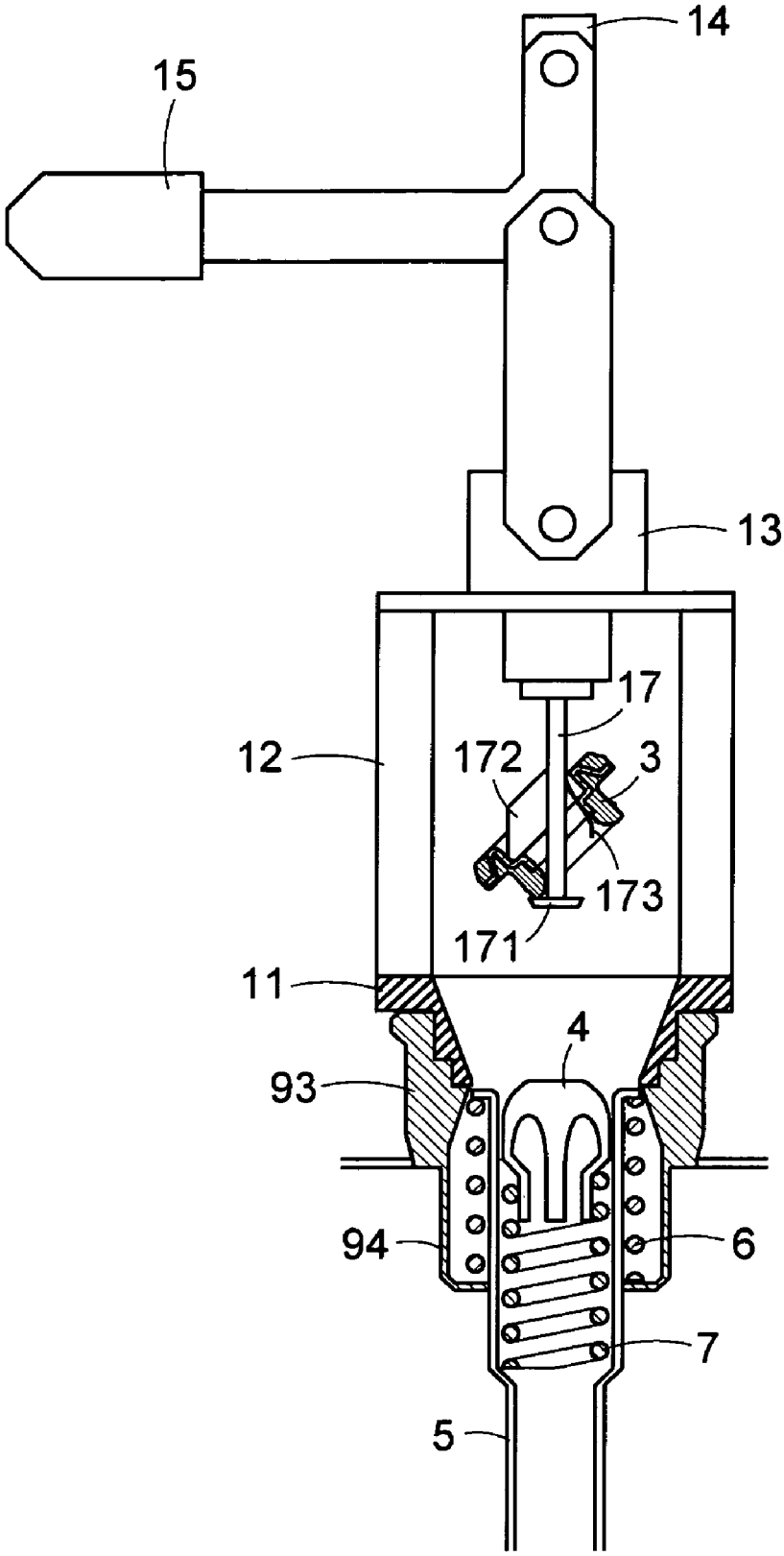
FIG. 9 is a view showing a procedure for incorporating the gas valve 3 into the fitting.

Next, referring to FIGS. 9 through 12, a procedure for incorporating the gas valve 3 into the fitting will be described. First, as shown in FIG. 9, the guide portion 11 of the operation tool 10 is fixed to the ferrule 93 of the beer barrel. Fixing is a simple operation performed by fitting the guide portion 11 into the ferrule 93 and rotating the guide portion 11. Next, the handle 15 is rotated to a leftward horizontal position to elevate the moving member 14 and the attachment tool 17 to the end of the upward stroke, whereby the gas valve 3 is supported on the attachment tool 17 at a tilt of approximately 45 degrees.

As shown in the drawing, the gas valve 3 is supported at a tilt of approximately 45 degrees by the upper surface of the pushing portion 171, the tip end of the support projection 172, and the support plate 173. At this time, the gas valve 3 is set such that the mark 313 on the gas valve 3 matches the direction of the support projection 172. In so doing, the long axis direction (the straight line A direction; see FIGS. 3 and 5) of the core metal is tilted approximately 45 degrees from the horizontal surface such that the gas valve 3 can pass through the central hole in the valve seat portion 95.

The coil spring 6 and down tube 5 that have been inserted into the attachment portion 94 formed integrally with the ferrule 93, through the central hole in the valve seat portion 95, are disposed in a predetermined position, as shown in the drawing. The coil spring 7 and the beer valve 4 are disposed in the upper end inner portion of the down tube 5.

Figure 10:
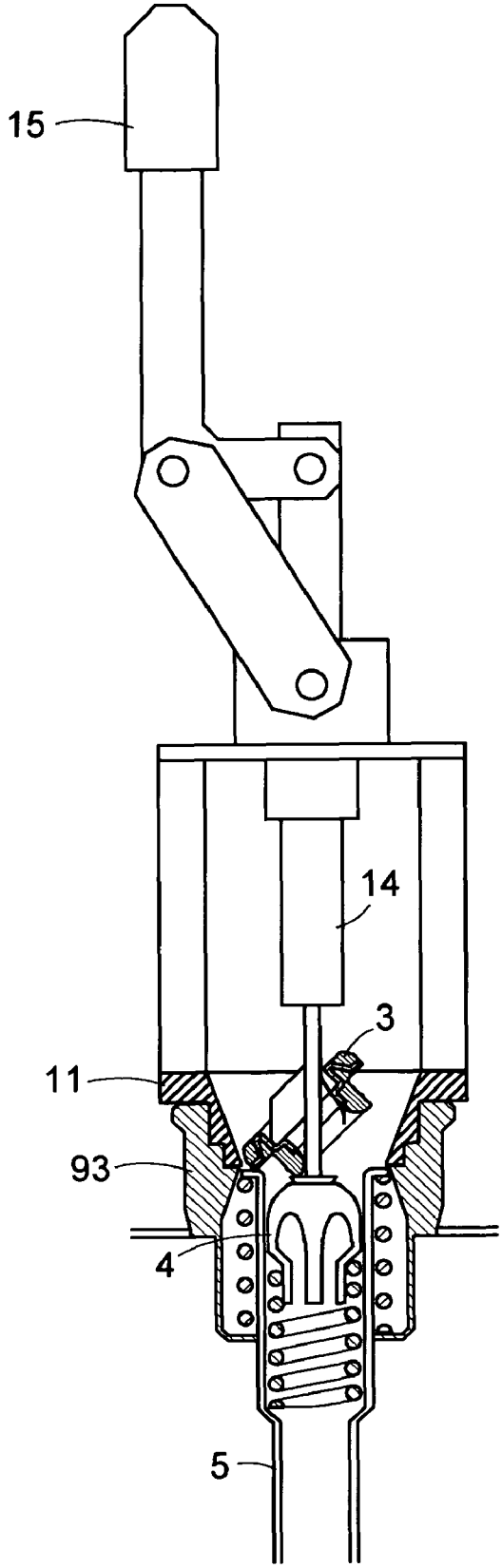
FIG. 10 is a view showing a procedure for incorporating the gas valve 3 into the fitting.

Next, as shown in FIG. 10, the handle 15 is rotated in a rightward direction. When the handle 15 reaches an upwardly vertical state, the gas valve 3 supported on the attachment tool 17 is lowered to the position shown in the drawing. At this time, the gas valve 3 is guided to the conical inner surface of the guide portion 11 and moved smoothly to an upper end position of the down tube 5. Further, the pushing portion 171 at the lower end of the attachment tool 17 comes into contact with the beer valve 4 and pushes the beer valve 4 down against the coil spring 7.

Figure 11:
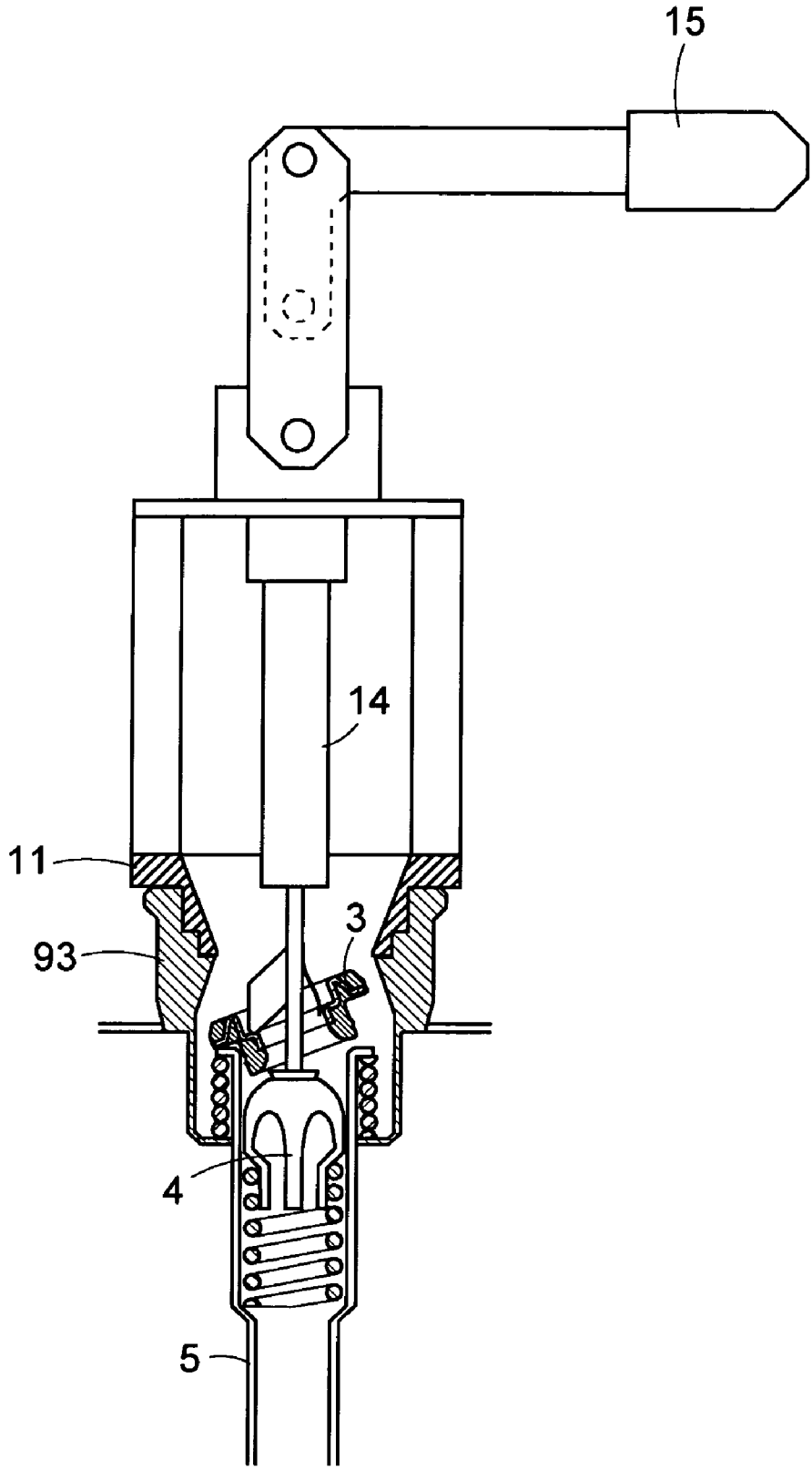
FIG. 11 is a view showing a procedure for incorporating the gas valve 3 into the fitting.

When the handle 15 is rotated further in the rightward direction to a rightward horizontal position, the state shown in FIG. 11 is attained. The moving member 14 and attachment tool 17 reach the end of the downward stroke. The gas valve 3 passes through the central hole in the valve seat portion 95 and advances through the interior of the fitting. The gas valve 3 then comes into contact with the upper end of the down tube 5 and pushes the down tube 5 down against the coil spring 6.

The down tube 5 has already been pushed down to a downward limit position, and therefore the down tube 5 pushes the gas valve 3 back upward. The gas valve 3 is separated from the elastic support plate 173 by the force of the support projection 172 and the upper end of the down tube 5, and rotates so as to approach a horizontal state. In this state, the gas valve 3 can be inserted into the upper end portion of the down tube 5.

Figure 12:
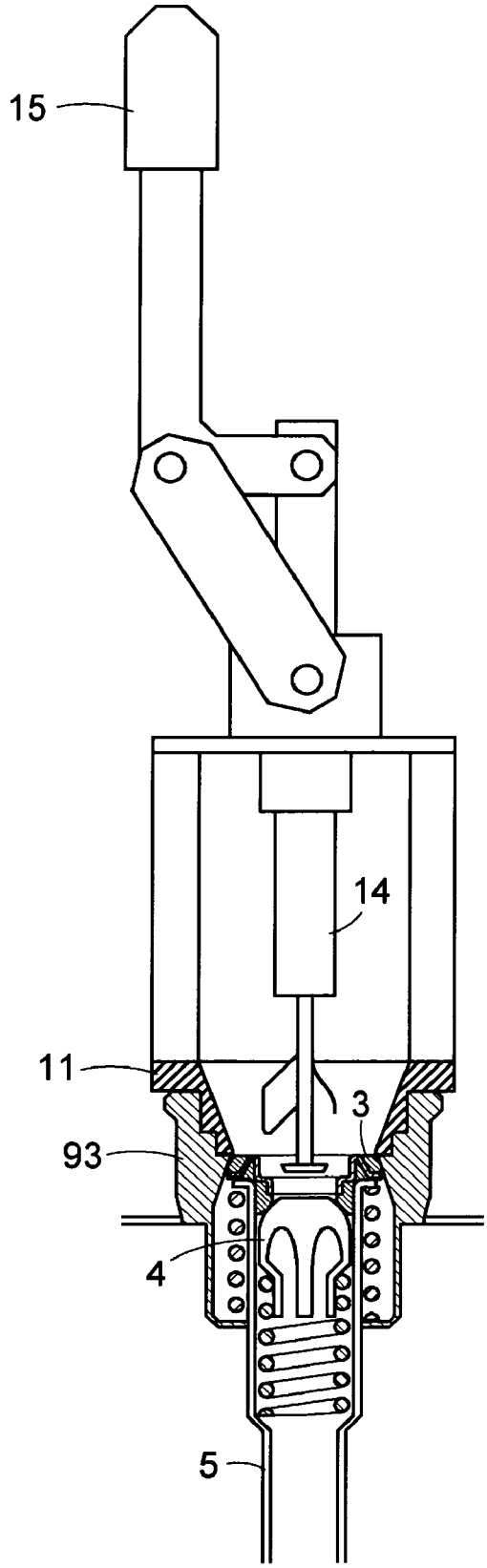
FIG. 12 is a view showing a procedure for incorporating the gas valve 3 into the fitting.

Next, the handle 15 is rotated back in the leftward direction. The gas valve 3 is close to a horizontal state, and therefore comes into contact with the valve seat portion 95 while rising, and as a result enters a horizontal state such that the lower small diameter portions of the gas valve 3 are fitted into the upper end portion of the down tube 5. This state is shown in FIG. 12. The handle 15 is then returned to an upwardly vertical state, whereby the gas valve 3 is inserted into the correct position on the upper end of the down tube 5. In the horizontal state, the gas valve 3 is incapable of passing through the central hole in the valve seat portion 95, and therefore contacts the valve seat portion 95 so as to perform an identical function to that of a conventional gas valve.

As described above, the gas valve 3 can be incorporated into the fitting easily using the operation tool 10. Even when the ferrule 93, valve seat portion 95 and attachment portion 94 are formed integrally, the gas valve 3 can be incorporated easily by providing the core metal with the small diameter portions.

When the gas valve 3 is used for a long time, the valve member 32, which is constituted by a flexible member made of rubber or the like, deteriorates such that the valve function is impaired. Therefore, the gas valve 3 is preferably detached and replaced with a new one after every three to six years of use. An operation to detach the gas valve 3 for replacement may also be performed simply using the operation tool 10. Next, referring to FIGS. 13 and 14, a procedure for detaching the gas valve 3 from the fitting will be described.

Figure 13:
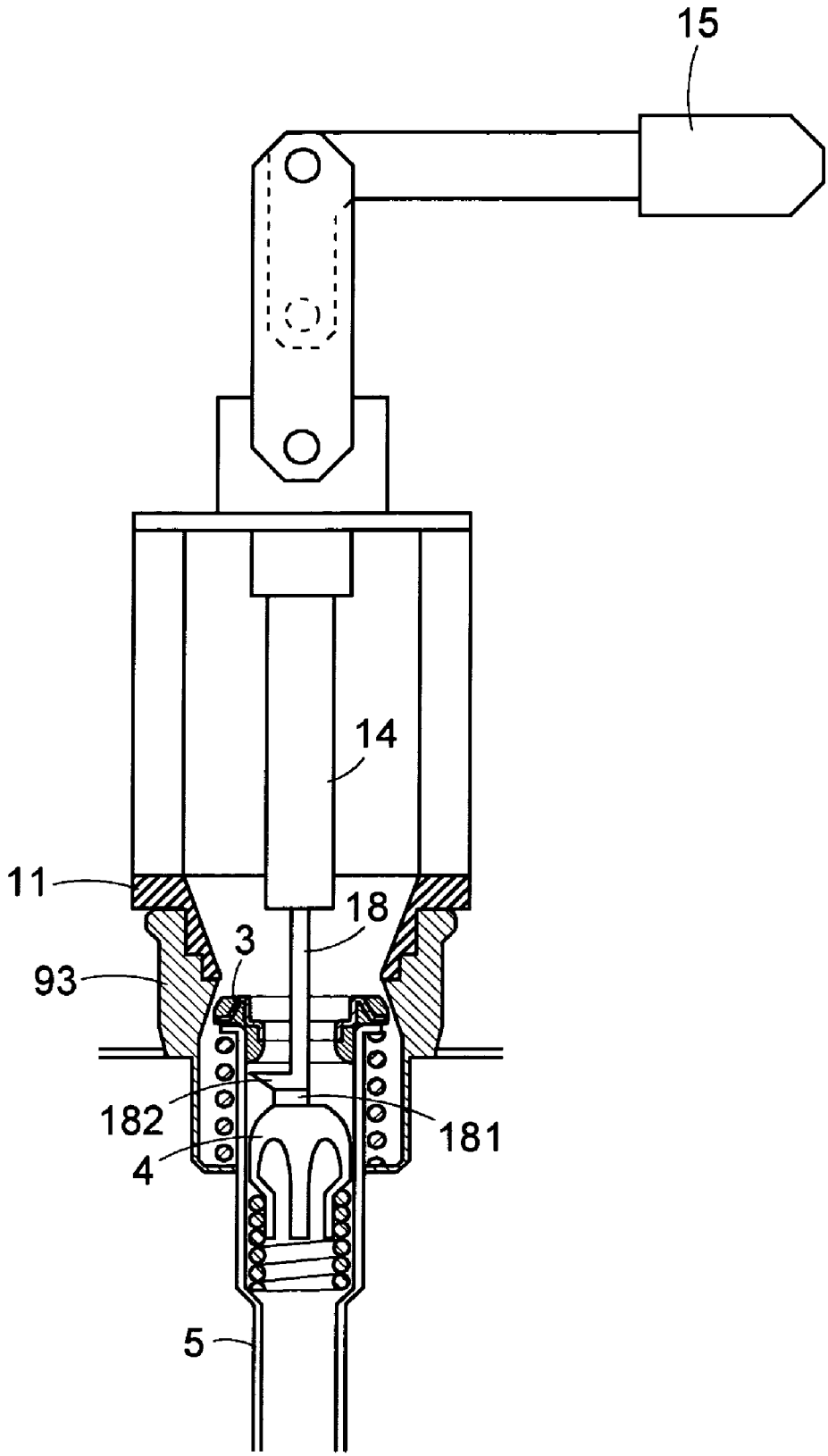
FIG. 13 is a view showing a procedure for detaching the gas valve 3 from the fitting.

First, as shown in FIG. 13, the detachment tool 18 is attached to the lower end of the moving member 14 on the operation tool 10. A pushing portion 181 for pushing the beer valve 4 downward is provided on the lower end of the detachment tool 18. A pawl portion 182 that projects in a lateral direction is provided on an upper portion of the pushing portion 181. As shown in the drawing, a lower surface side of the pawl portion 182 is formed with an inclined surface.

Next, the guide portion 11 of the operation tool 10 is fixed to the ferrule 93 of the beer barrel. At this time, it is confirmed that the projection direction of the pawl portion 182 matches the direction of the mark 313 on the gas valve 3. Since the direction of the support projection 172 on the attachment tool 17 is identical to the direction of the pawl portion 182 on the detachment tool 18, the direction of the mark on the gas valve 3 incorporated by the operation tool 10 generally corresponds to the projection direction of the pawl portion 182. Note, however, that the mark direction may not be aligned when the gas valve 3 is incorporated using another tool, and therefore the projection direction of the pawl portion 182 is preferably made modifiable.

Next, the handle 15 is rotated to the rightward horizontal position to lower the moving member 14 and detachment tool 18 to the end of the downward stroke. During this lowering process, the pawl portion 182 of the detachment tool 18 comes into contact with the gas valve 3, but since the lower surface of the pawl portion 182 is an inclined surface, a lateral direction force acts on the detachment tool 18 such that the detachment tool 18 deforms elastically in the lateral direction, and therefore the pawl portion 182 can be lowered until it reaches the lower surface of the gas valve 3.

Figure 14:
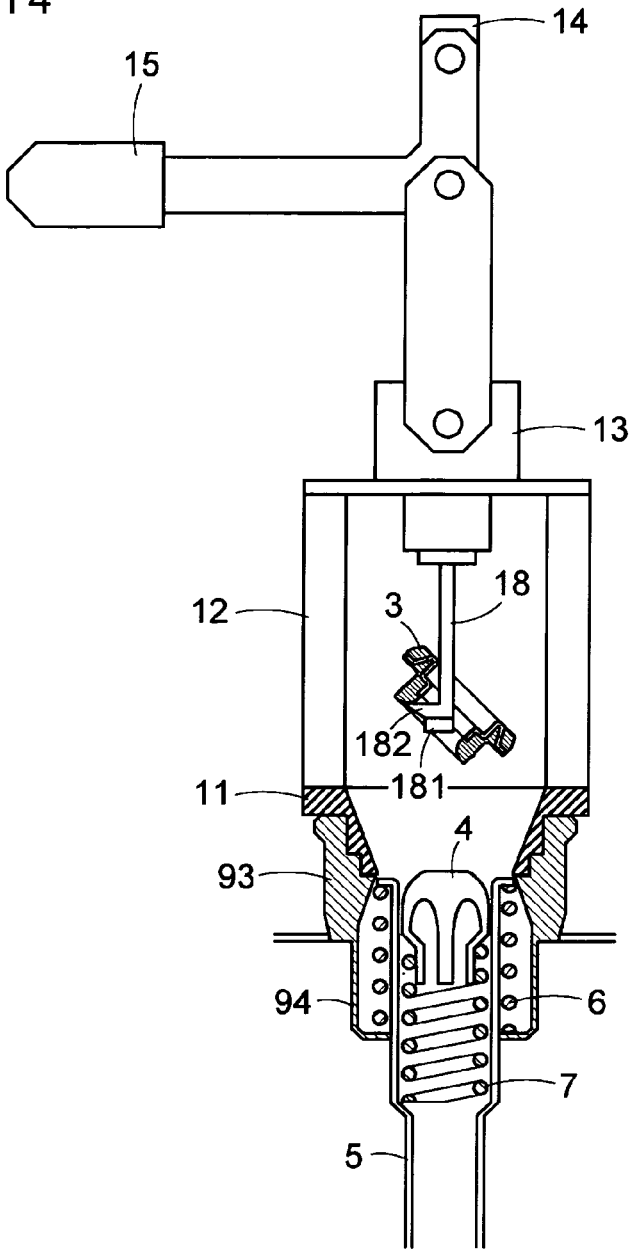
FIG. 14 is a view showing a procedure for detaching the gas valve 3 from the fitting.

Next, as shown in FIG. 14, the handle 15 is rotated to the leftward horizontal position to elevate the moving member 14 and detachment tool 18 to the end of the upward stroke. The pawl portion 182 engages with the lower surface of the gas valve 3 such that the gas valve 3 is detached from the upper end portion of the down tube 5, whereupon the gas valve 3 is tilted and pulled upward. The pawl portion 182 pulls the gas valve 3 upward in the long axis direction indicated by the mark 313, thereby tilting the long axis of the core metal, and as a result, the gas valve 3 can be passed through the central hole in the valve seat portion 95. Thus, as shown in the drawing, the gas valve 3 can be detached completely from the fitting.

As described above, to incorporate a new gas valve 3 into the fitting, an operation may be performed in accordance with the procedures illustrated in FIGS. 9 to 12. As noted above, operations to attach, detach and replace the gas valve 3 can be performed easily using the operation tool 10. In the fitting of the present invention, the gas valve 3 is the only component that needs to be subjected to maintenance operations such as replacement, and since an operation to replace the gas valve 3 can be performed easily, maintenance operation costs can be reduced greatly.

Figure 15:
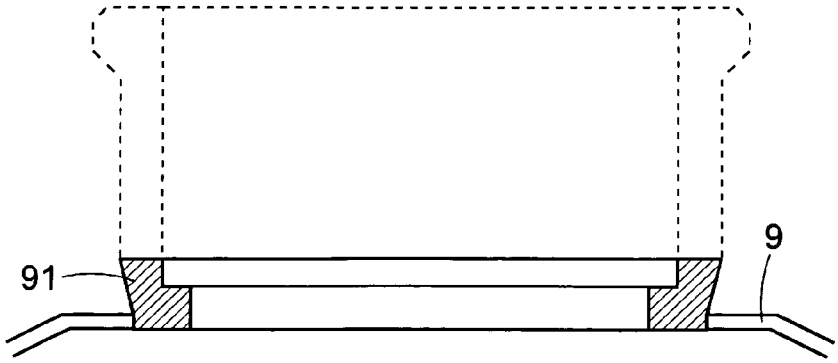
FIG. 15 is a view showing a procedure for attaching the fitting of the present invention after improving a beer barrel comprising a conventional fitting.
Figure 16:
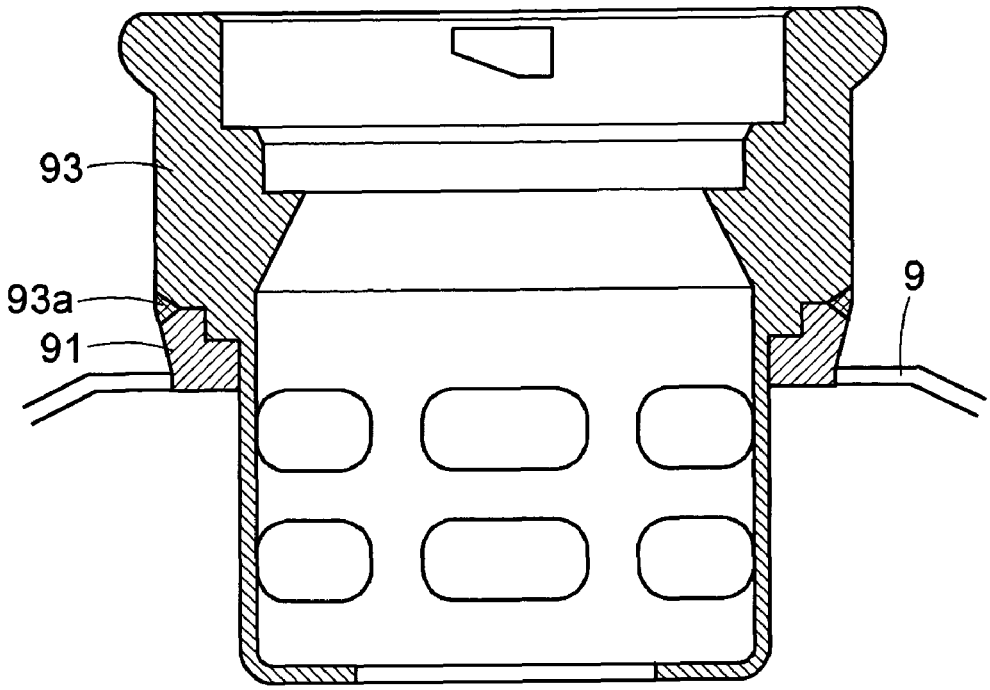
FIG. 16 is a view showing a procedure for attaching the fitting of the present invention after improving a beer barrel comprising a conventional fitting.

Next, a procedure for attaching the fitting according to the first embodiment of the present invention after improving a beer barrel 9 provided with a conventional fitting, such as that shown in FIGS. 25 and 26, will be described. FIGS. 15 and 16 show this procedure. First, the attachment member 2, down tube 5, gas valve 3, beer valve 4 and coil springs are detached from the ferrule 91 of a conventional beer barrel 9 such as that shown in FIG. 26, and the packing 92 is also removed. The ferrule 91 is then cut midway to a predetermined height from the connecting portion with the beer barrel 9, whereby a shape such as that shown in FIG. 15 is obtained.

A step shape is then cut near the beer barrel 9 connecting portion of the ferrule 93 of the fitting according to the first embodiment to obtain a shape that aligns with the remaining portion of the ferrule 91 in FIG. 15. Note that the improvement ferrule 93 may be formed with a step shape in the connecting portion from the start. The ferrule 93 is fitted tightly onto the remaining portion of the ferrule 91 as shown in FIG. 16, whereupon the outer periphery of the joint portion is hermetically fixed by welding, as shown by a welded portion 93*a*. Each component of the fitting may then be incorporated into the ferrule 93.

Thus, the fitting of the present invention can be attached through effective use of a beer barrel to which a conventional fitting is attached, and therefore the cost of introducing the fitting of the present invention can be reduced greatly, and effective use of resources can be achieved.

Figure 17:
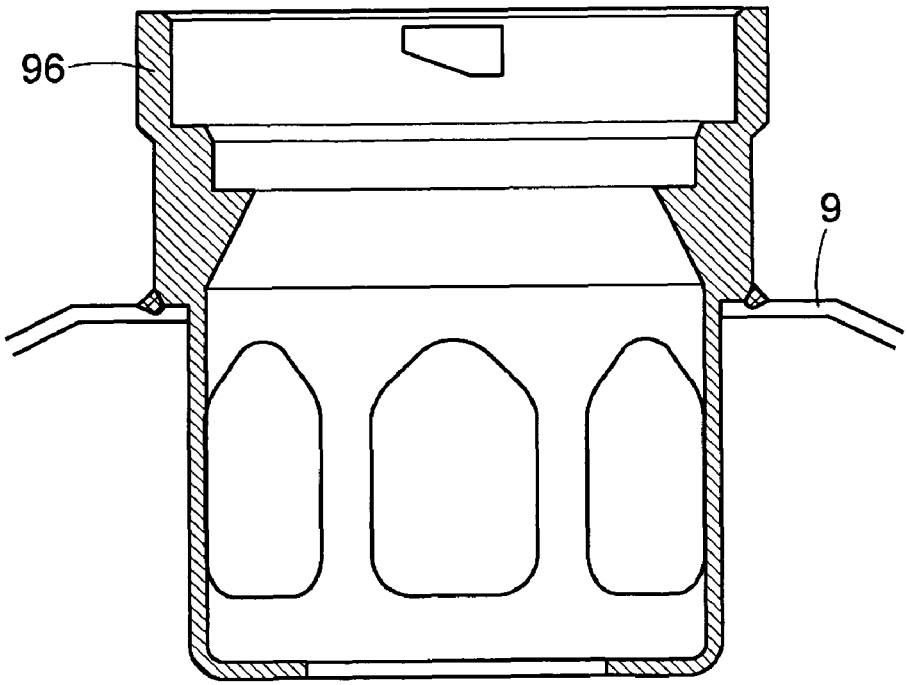
FIG. 17 is a view showing a fitting according to a third embodiment of the present invention.

Next, a fitting according to a third embodiment of the present invention will be described. FIG. 17 is a view showing the constitution of a ferrule 96 for the fitting of the third embodiment. The ferrule 96 is joined to the beer barrel 9 through welding or the like. The joint portion is airtight and watertight. The inner surface side of the ferrule 96 has an identical structure to that of the ferrule 93 shown in FIG. 1, and the dimensions and disposition of the engaging projection and valve seat portion are also identical. An attachment portion 94 has a different window shape but is functionally identical. In the ferrule 96, the outer peripheral side is formed entirely in a small-diameter shape, and therefore the ferrule 96 is smaller and lighter than the ferrule 93.

Since the structure on the inner surface side of the ferrule 96 is identical to the ferrule 93, the other components of the fitting (the down tube 5, gas valve 3, beer valve 4 and so on) can be incorporated in an identical fashion to the ferrule 93. Further, a beer filling machine, a barrel washing machine, a beer dispensing tool (a dispensing head or the like) and so on that are used with the conventional beer barrel shown in FIG. 25 can all be employed as is in a beer barrel comprising the ferrule 96.

The fitting employing the ferrule 96 is small and lightweight, and is therefore suited to a comparatively low-volume beer barrel. When the fitting of the third embodiment is used, the overall size and weight of the beer barrel can be reduced, enabling reductions in transportation cost and storage space. Moreover, by reducing the size of the beer barrel, individual beer barrels can be stored and cooled in a refrigerator.

Figure 18:
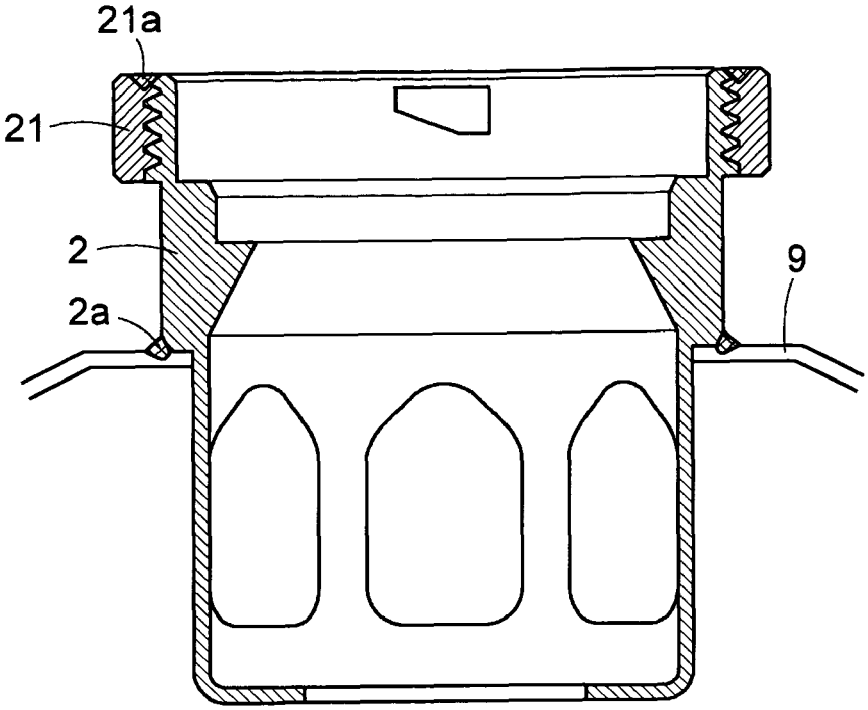
FIG. 18 is a view showing a procedure for manufacturing an equivalent to the fitting according to the third embodiment using an attachment member 2 of a conventional fitting.

Next, a procedure for manufacturing an equivalent of the fitting according to the third embodiment, described above, using the attachment member 2 of a conventional fitting will be described. The attachment member 2 of a conventional fitting such as that shown in FIG. 26 has a similar structure to the ferrule 96 described above, and therefore can be used as the equivalent of the ferrule 96. The inner surface side structure of the attachment member 2 is identical to that of the ferrule 96, and the dimensions and disposition of the engaging projection and valve seat portion are also identical. As shown in FIG. 18, the attachment member 2 is joined directly to the beer barrel 9 by welding or the like. A joint portion 2*a* is airtight and watertight.

Note, however, that a male screw portion is formed on the upper portion outer periphery of the attachment member 2, and therefore a protective ring 21 is screwed to the male screw portion to make the outer peripheral surface flat. A welding portion 21*a* produced by spot welding or the like is formed in the connecting portion between the protective ring 21 and the attachment member 2, and thus the protective ring 21 and attachment member 2 are joined together fixedly such that the protective ring 21 does not become detached. Thus, the attachment member 2 can be used in a substantially identical manner to the ferrule 96. The other components of the fitting (the down tube 5, gas valve 3, beer valve 4 and so on) can be incorporated in a similar fashion to the ferrule 93.

Hence, the attachment member 2 of a conventional fitting can be used effectively as the fitting of the present invention, and therefore the cost of introducing the fitting according to the present invention can be reduced greatly, and effective use of resources can be achieved.

Figure 19:
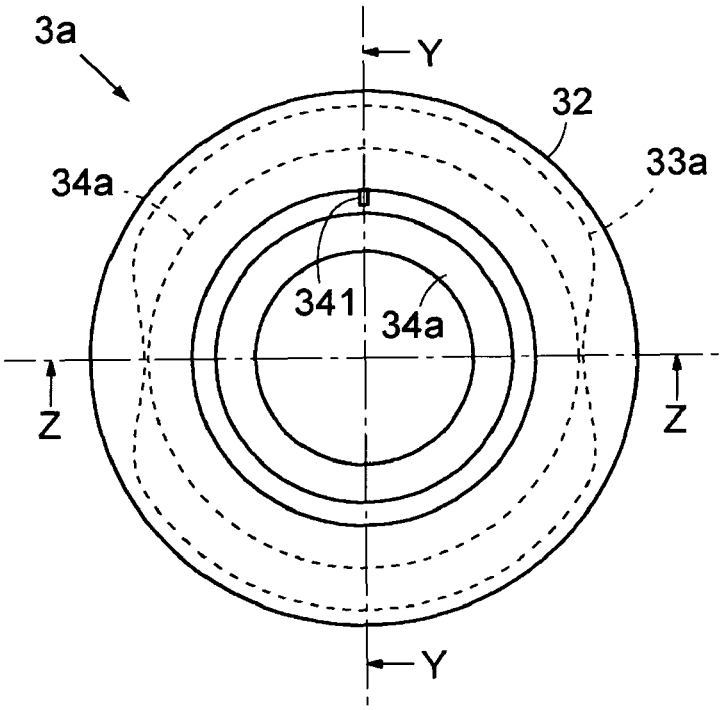
FIG. 19 is a plan view showing the constitution of a gas valve 3*a* according to another embodiment.
Figure 20:
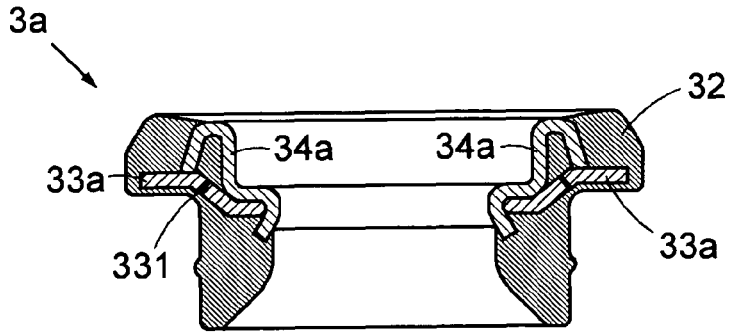
FIG. 20 is a sectional view of the gas valve 3*a* seen from a Y-Y arrow.
Figure 21:
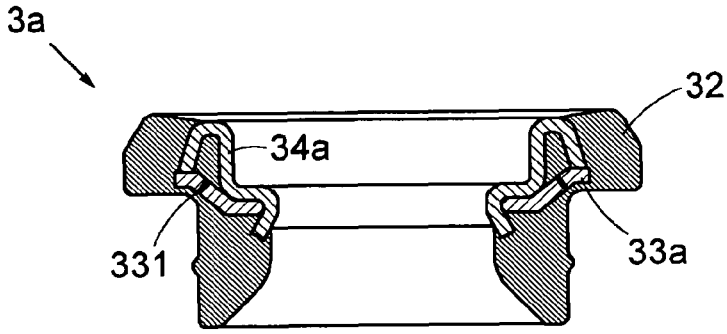
FIG. 21 is a sectional view of the gas valve 3*a* seen from a Z-Z arrow.

Next, a gas valve according to another embodiment will be described. FIG. 19 is a plan view showing the constitution of a gas valve 3*a* according to another embodiment. FIG. 20 is a sectional view of the gas valve 3*a* seen from a Y-Y arrow in FIG. 19, and FIG. 21 is a sectional view of the gas valve 3*a* seen from a Z-Z arrow in FIG. 19. In other words, FIG. 20 is a sectional view cut along a plane including the long axis of a core metal 33*a*, and FIG. 21 is a sectional view cut along a plane including the short axis of the core metal 33*a*.

The gas valve 3*a* differs from the gas valve 3 shown in FIG. 2 in the constitution of the core metal. The core metal 31, 31*a* (see FIGS. 3 to 5) of the gas valve 3 is formed by a single member, but in the gas valve 3*a*, a reinforcement metal fitting 34*a* is molded integrally into the gas valve 3*a* in addition to the core metal 33*a*.

The plan outer peripheral shape (outer peripheral side contour) of the core metal 33*a* is similar to the plan outer peripheral shape of the core metal 31*a* shown in FIG. 5. The plan outer peripheral shape of the core metal 33*a* has similar symmetrical axes to the plan outer peripheral shape of the core metal 31*a*, and likewise has a constant diameter portion and small diameter portions. The small diameter portions are constituted by smooth curves. Note that the plan outer peripheral shape of the core metal 33*a* may be made similar to the plan outer peripheral shape of the core metal 31. The inner peripheral side of the core metal 33*a* is formed in a circle. The core metal 33*a* is formed in a shape that has fewer up and down bends than the core metal 31*a* and is therefore closer to being planar. Further, a plurality of small-diameter through holes 331 penetrating the upper surface side and lower surface side are provided in the core metal 33*a*.

As shown in the drawings, the outer peripheral side contour of the reinforcement metal fitting 34*a* is also formed in a circle, and thus the reinforcement metal fitting 34*a* takes a ring shape exhibiting rotational symmetry. Note, however, that a mark 341 indicating the long axis direction of the core metal 33*a* is formed on an upper surface apex portion of the reinforcement metal fitting 34*a*. The mark 341 is formed as a shallow groove, and during integral molding to form the gas valve 3*a*, the rubber material or the like of the valve member 32 flows into the groove of the mark 341, thereby making the mark 341 highly visible.

The core metal 33*a* and reinforcement metal fitting 34*a* are combined as shown in FIGS. 20 and 21 and connected integrally. At this time, the core metal 33*a* and reinforcement metal fitting 34*a* are combined such that the mark 341 on the reinforcement metal fitting 34*a* is oriented in the long axis direction of the core metal 33*a*. A lower end portion of the inner peripheral side of the reinforcement metal fitting 34*a* is formed in a vertical direction prior to connection, but when the core metal 33*a* and reinforcement metal fitting 34*a* are combined, the lower end portion of the inner peripheral side of the reinforcement metal fitting 34*a* is pushed outward as shown in the drawings. By increasing the diameter of the inner peripheral side lower end portion of the reinforcement metal fitting 34*a* in this manner, the reinforcement metal fitting 34*a* is connected integrally to the inner peripheral portion of the core metal 33*a*.

The gas valve 3*a* is manufactured by integrally molding the integrally connected core metal 33*a* and reinforcement metal fitting 34*a* with the valve member 32, which is constituted by a flexible member made of rubber or the like. Note that the core metal 33*a* and reinforcement metal fitting 34*a* are made of a stainless material or the like. For example, a press-formed component constituted by a stainless plate material having a plate thickness of 1.5 mm may be used as the core metal 33*a*, and a press-formed component constituted by a stainless plate material having a plate thickness of 1.0 mm may be used as the reinforcement metal fitting 34*a*. When the core metal 33*a* and reinforcement metal fitting 34*a* are molded integrally with the valve member 32, the valve member 32 made of a rubber material or the like flows into the through holes 331, and therefore the valve member 32 is filled into a space portion between the core metal 33*a* and the reinforcement metal fitting 34*a* without gaps.

The gas valve 3*a* may be incorporated into the fitting in an identical manner to the gas valve 3 shown in FIG. 2 using the operation tool 10, and detachment and replacement can also be performed in an identical manner. In the gas valve 3*a*, the core metal 33*a* and reinforcement metal fitting 34*a* are molded integrally with the valve member 32, and the valve member 32 is adhered forcefully to the core metal 33*a* and reinforcement metal fitting 34*a*. Therefore, an increase in strength and an improvement in durability can be achieved in the gas valve.

Figure 22:
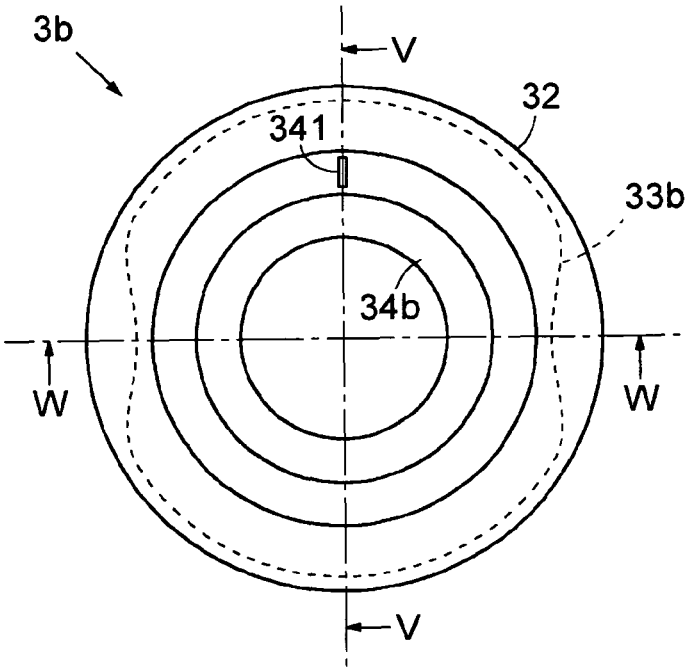
FIG. 22 is a plan view showing the constitution of a gas valve 3*b* according to another embodiment.
Figure 23:
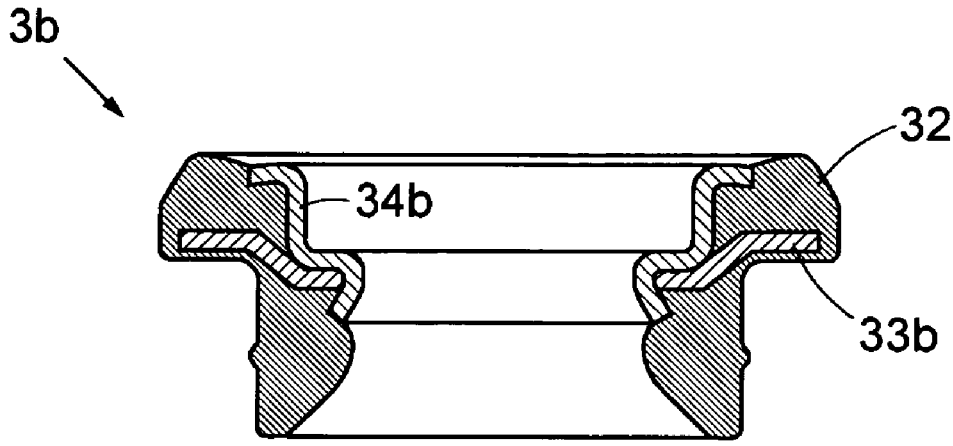
FIG. 23 is a sectional view of the gas valve 3*b* seen from a V-V arrow.
Figure 24:
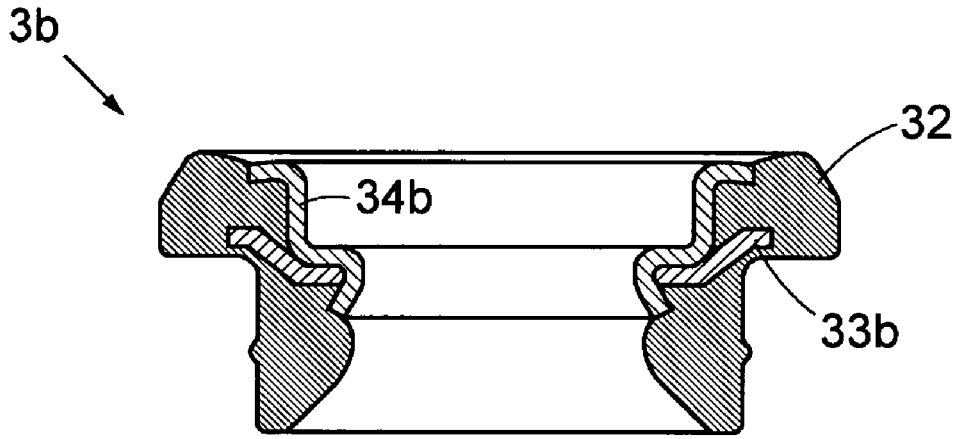
FIG. 24 is a sectional view of the gas valve 3*b* seen from a W-W arrow.

FIG. 22 is a plan view showing the constitution of a gas valve 3*b* according to another embodiment. FIG. 23 is a sectional view of the gas valve 3*b* seen from a V-V arrow in FIG. 22, and FIG. 24 is a sectional view of the gas valve 3*b* seen from a W-W arrow in FIG. 22. In other words, FIG. 23 is a sectional view cut along a plane including the long axis of a core metal 33*b*, and FIG. 24 is a sectional view cut along a plane including the short axis of the core metal 33*b*.

The gas valve 3*b* has a similar constitution to the gas valve 3*a*, but differs from the gas valve 3*a* in the shape of a reinforcement metal fitting 34*b* and the manufacturing method. In the gas valve 3*b*, first, the core metal 33*b* and the valve member 32 are molded integrally. The constitution of the core metal 33*b* is substantially identical to that of the core metal 33*a*. However, no through holes are provided in the core metal 33*b*. The plan outer peripheral shape of the core metal 33*b* has similar symmetrical axes to the plan outer peripheral shape of the core metal 31*a*, and likewise has a constant diameter portion and small diameter portions. The small diameter portions are constituted by smooth curves. Note that the plan outer peripheral shape of the core metal 33*b* may be made similar to the plan outer peripheral shape of the core metal 31.

Similarly to the reinforcement metal fitting 34*a*, the mark 341 indicating the long axis direction of the core metal 33*b* is formed on the upper surface apex portion of the reinforcement metal fitting 34*b*. The reinforcement metal fitting 34*b* is inserted into a central hole of the molded body formed by integrally molding the core metal 33*b* and the valve member 32 from above so as to be connected thereto integrally in the manner shown in the drawings. At the time of insertion, the reinforcement metal fitting 34*b* is inserted such that the direction of the mark on the reinforcement metal fitting 34*b* corresponds to the long axis direction of the core metal 33*b*.

As shown in the drawings, the reinforcement metal fitting 34*b* is shaped so as to cover the upper surface inner peripheral side part of the gas valve 3*b* and the inner peripheral surface thereof. A lower end portion of the inner peripheral side of the reinforcement metal fitting 34*b* is formed in a vertical direction prior to connection, but the lower end portion of the inner peripheral side of the reinforcement metal fitting 34*b* is pushed outward as shown in the drawings. Further, the upper surface outer periphery of the reinforcement metal fitting 34*b* is bent downward so as to cut into the valve member 32. By increasing the diameter of the inner peripheral side lower end portion of the reinforcement metal fitting 34*b* and bending the upper surface outer periphery downward in this manner, the reinforcement metal fitting 34*b* is connected integrally to the inner peripheral portion of the core metal 33*b*, and thus the gas valve 3*b* integrating the valve member 32, the core metal 33*b* and the reinforcement metal fitting 34*b* is obtained.

The gas valve 3*b* may be incorporated into the fitting in an identical manner to the gas valve 3 shown in FIG. 2 using the operation tool 10, and detachment and replacement can also be performed in an identical manner. In the gas valve 3*b*, the core metal 33*b* and reinforcement metal fitting 34*b* are integrated with the valve member 32, and therefore an increase in strength and an improvement in durability can be achieved in the gas valve. The process for manufacturing the gas valve 3*b* is even easier than that of the gas valve 3*a*, and therefore the gas valve 3*b* can be manufactured at low cost. Furthermore, in terms of the strength and durability of the gas valve, the gas valve 3*b* is the equal of the gas valve 3*a*.

According to the present invention described above, an attachment portion and a valve seat portion are provided integrally with the ferrule of a beer barrel, and therefore no gaps exist between the ferrule and the upper surface of the attachment member, meaning that no foreign matter, dirty water and so on enters through such gaps. As a result, sterilization processing of the ferrule, operations to remove foreign matter and so on can be reduced. Furthermore, a packing replacement operation can be eliminated and a gas valve replacement operation can be performed easily, and therefore a large reduction in maintenance operations can be achieved. Moreover, the number of components of the fitting can be reduced, enabling a reduction in the manufacturing cost of the beer barrel. In addition, the outer diameter dimension and weight of the ferrule can be reduced while maintaining compatibility with a conventional fitting, and therefore the size and weight of the beer barrel can be reduced.

Note that in the above embodiments, draft beer is used as an example of a beverage, and a beer barrel is used as an example of a beverage container, but the present invention may be applied to other arbitrary beverages and beverage containers.

INDUSTRIAL APPLICABILITY

According to the present invention, no gaps exist between a ferrule and an attachment member, and therefore a hygienic fitting for a beverage container that is not infiltrated by foreign matter, dirty water and so on can be provided at low cost. Moreover, maintenance operations on the beverage container fitting can be reduced greatly.

The invention claimed is:

1. A fitting for a beverage container comprising:

an attachment portion provided integrally with a ferrule of a beverage container;

a valve seat portion provided on an inner peripheral side of said attachment portion;

a tubular down tube, an upper end portion of which is supported by said attachment portion;

a gas valve fitted onto said upper end portion of said down tube for supplying a pressurized gas to the interior of said container; and a beverage valve provided in the interior of said upper end portion of said down tube for dispensing a beverage to the exterior of said container, wherein said gas valve can be replaced through a central hole in said valve seat portion, said gas valve includes a metallic core metal and a valve member with increased flexibility molded integrally with said core metal, said gas valve is capable of passing through said central hole in said valve seat portion when tilted, but incapable of passing through said central hole in said valve seat portion when horizontal, including an annular member defining a core metal opening extending circumferentially about a center axis and a flange portion connected to the annular member and extending radially outwardly therefrom to terminate in a pair of arcuate sections and a pair of non-arcuate sections, respective ones of the pair of arcuate sections and the non-arcuate sections being opposed to each other in a manner that the respective ones of the pairs of arcuate sections and non-arcuate sections are serially connected to each other to form a generally oval-racetrack shape, a first distance measured to and between the pair of arcuate sections through the center axis is larger than a second distance measured to and between the pair of non-arcuate sections through the center axis.

2. The fitting for a beverage container according to claim 1, wherein each one of the pair of non-arcuate sections is formed as a line segment which is positioned at a distance from said center enabling passage through said central hole in said valve seat portion.

3. The fitting for a beverage container according to claim 1, wherein each one of the pair of non-arcuate sections forms a curve that curves inwardly toward the center axis.

4. The fitting for a beverage container according to claim 1, wherein said gas valve is formed by integrally molding a metal fitting, which is formed by integrally connecting said core metal to a reinforcement metal fitting, with said valve member.

5. The fitting for a beverage container according to claim 1, wherein said gas valve is formed by molding said core metal integrally with said valve member and then integrally connecting a reinforcement metal fitting thereto.

6. The fitting for a beverage container according to any one of claims 1 to 5, wherein a mark indicating the direction of said first straight line is displayed on said gas valve.

7. The fitting for a beverage container according to claim 6, wherein said mark on said gas valve is formed when a material of said valve member flows into a recessed groove provided in a metallic part and hardens.

* * * * *